US010532581B2

(12) United States Patent
Iida et al.

(10) Patent No.: US 10,532,581 B2
(45) Date of Patent: Jan. 14, 2020

(54) INK-JET RECORDING APPARATUS

(71) Applicant: Brother Kogyo Kabushiki Kaisha, Nagoya-shi, Aichi-ken (JP)

(72) Inventors: Shotaro Iida, Nagoya (JP); Satoru Arakane, Nagoya (JP); Tomohiro Nodsu, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/111,303

(22) Filed: Aug. 24, 2018

(65) Prior Publication Data

US 2019/0061368 A1 Feb. 28, 2019

(30) Foreign Application Priority Data

Aug. 29, 2017 (JP) ..... 2017-163906

(51) Int. Cl.
*B41J 2/195* (2006.01)
*B41J 2/175* (2006.01)
(Continued)

(52) U.S. Cl.
CPC ..... *B41J 2/195* (2013.01); *B41J 2/04536* (2013.01); *B41J 2/04551* (2013.01); *B41J 2/04553* (2013.01); *B41J 2/04571* (2013.01); *B41J 2/04581* (2013.01); *B41J 2/04588* (2013.01); *B41J 2/04595* (2013.01); *B41J 2/16508* (2013.01); *B41J 2/16511* (2013.01); *B41J 2/16517* (2013.01); *B41J 2/17509* (2013.01);
(Continued)

(58) Field of Classification Search
CPC .... B41J 2/04581; B41J 2/04588; B41J 29/38; B41J 2/04571; B41J 2/04551; B41J 2/04595; B41J 2/16517; B41J 2/17509; B41J 2002/14459; B41J 2/04536; B41J 2/04553; B41J 2/16508; B41J 2/17566; B41J 2/195; B41J 2002/17569; B41J 2202/10; B41J 29/393; B41J 2/165; B41J 2/16511; B41J 2/17546
USPC ..... 347/5, 6, 10, 12, 14, 47
See application file for complete search history.

(56) References Cited

U.S. PATENT DOCUMENTS

2002/0140748 A1 10/2002 Kanaya et al.
2004/0189732 A1* 9/2004 Usuda ..... B41J 2/04571 347/19
2012/0229543 A1* 9/2012 Hayashi ..... B41J 2/04571 347/10

FOREIGN PATENT DOCUMENTS

JP 2000-218817 A 8/2000
JP 2004-50417 A 2/2004
JP 2014-162026 A 9/2014

* cited by examiner

*Primary Examiner* — Jannelle M Lebron
(74) *Attorney, Agent, or Firm* — Banner & Witcoff, Ltd.

(57) ABSTRACT

An ink-jet recording apparatus includes: an ink-jet head provided with first and second nozzles for jetting a first ink and a second ink respectively, first and second drive elements which apply energy to the first and second inks respectively; a power supply circuit; and a controller. The controller estimates viscosity of the first ink in the first nozzle, controls the power supply circuit to generate a first drive voltage or a second drive voltage higher than the first drive voltage based on the viscosity of the first ink in the first nozzle estimated, drives the first and second drive elements by use of the drive voltage generated in the power supply circuit, and calculates a jetting amount of the first ink to be jetted from the first nozzle and a jetting amount of the second ink to be jetted from the second nozzle.

20 Claims, 13 Drawing Sheets

(51) Int. Cl.

| | |
|---|---|
| ***B41J 29/38*** | (2006.01) |
| ***B41J 2/045*** | (2006.01) |
| ***B41J 2/165*** | (2006.01) |
| ***B41J 2/14*** | (2006.01) |

(52) U.S. Cl.
CPC ..... *B41J 2/17546* (2013.01); *B41J 2/17566* (2013.01); *B41J 29/38* (2013.01); *B41J 2002/14459* (2013.01); *B41J 2002/17569* (2013.01); *B41J 2202/10* (2013.01)

Fig. 6B

LIQUID-DROPLET AMOUNT DEFINITION TABLE

| DRIVE PULSE SIGNAL | SMALL DROPLET | MEDIUM DROPLET | LARGE DROPLET |
|---|---|---|---|
| LIQUID-DROPLET AMOUNT | A | B | C |

Fig. 6C

VOLTAGE SENSITIVITY TABLE

| DRIVE PULSE SIGNAL | SMALL DROPLET | MEDIUM DROPLET | LARGE DROPLET |
|---|---|---|---|
| YELLOW(Y) | D | E | F |
| MAGENTA(M) | G | H | I |
| CYAN(C) | J | K | L |

INK-JET RECORDING APPARATUS

CROSS REFERENCE TO RELATED APPLICATION

The present application claims priority from Japanese Patent Application No. 2017-163906 filed on Aug. 29, 2017, the disclosure of which is incorporated herein by reference in its entirety.

BACKGROUND

Field of the Invention

The present invention relates o an ink-jet recording apparatus.

Description of the Related Art

There is known an ink-jet recording apparatus that is capable of jetting four colors of inks, as an exemplary ink-jet recording apparatus that is capable of jetting multiple kinds of inks. In this ink-jet recording apparatus, piezo elements (drive elements) and channels connecting nozzles and an ink cartridge (ink tank) are provided for each of the ink colors. Each of the inks is jetted from the nozzle by using deformation of the piezo element caused when a drive pulse signal having a predefined drive voltage is applied between two kinds of electrodes provided at both ends of the piezo element.

In the above inkjet recording apparatus, a jetting amount of ink to be jetted from the nozzle is calculated to detect a residual amount of ink in the ink tank. Specifically, weight (a volume) of ink per one liquid droplet is stored in advance as a unit ink amount. The jetting amount of ink to be jetted in a predefined period is calculated by multiplying the number of liquid droplets of ink jetted in the predefined period by the unit ink amount.

SUMMARY

There is an ink-jet recording apparatus that applies a drive voltage commonly to multiple drive elements corresponding to multiple kinds of inks. A waveform of a drive pulse signal is typically set so that the liquid droplet of each of the inks is jetted from each nozzle by a predefined volume under normal conditions.

Since the multiple kinds of inks have mutually different compositions, viscosity of one of the inks in the nozzle may become greatly higher than viscosities of the remaining other inks in the nozzles. For example, one of the inks used for the ink-jet recording apparatus may be a pigment ink, and the remaining other inks may be dye inks. Although the pigment ink has advantages, for example, of improving clarity of a printed image, the pigment of the pigment ink would fall on the bottom of the ink tank after being left stationary for a long time. This problem makes a pigment concentration of the pigment ink at the bottom of the ink tank locally high, thus making the viscosity thereof locally high. Thus, if the pigment ink having the high viscosity is supplied to the nozzle, the viscosity of the ink in the nozzle would greatly increase. This may make the viscosity of the pigment ink in the nozzle greatly higher than the viscosities of the dye inks in the nozzles.

There is a case in which all the inks used for the ink-jet recording apparatus are pigment inks. Those pigment inks are different in likelihood of the pigment fall due to the difference in diameters of pigment particles, the difference in contained amounts of the pigment particles, and the like. In that case, the pigment fall may cause the viscosity of one of the pigment inks in the nozzle to become greatly higher than the viscosities of the remaining other pigment inks in the nozzles.

There is a case in which multiple kinds of inks having mutually different amounts of evaporation per unit time are adopted as inks used for the ink-jet recording apparatus. For example, multiple kinds of dye inks have mutual different water contents, which makes the amounts of evaporation per unit time different from each other. Thus, the dye inks have mutually different degrees of progress of the increase in ink viscosity. For example, if all the inks used for the ink jet recording apparatus are dye inks, water evaporation may cause the viscosity, of one of the dye inks having a large amount of evaporation per unit time, in the nozzle to become greatly higher than the viscosities, of the remaining other dye inks having small amounts of evaporation per unit time, in the nozzles.

As described above, the increase in viscosity of one of the multiple kinds of inks in the nozzle may increase a frictional resistance in the channel, making it hard to jet liquid droplets of that ink from the nozzle. In order to jet the liquid droplets of that ink from the nozzle, the above-described drive voltage to be applied commonly to the drive elements corresponding to the multiple kinds of inks is required to increase. The increase in the drive voltage, however, causes the remaining other inks to be jetted from the nozzles as liquid droplets having a volume larger than the predefined volume. The above calculation method thus is not capable of accurately calculating the jetting amounts of the remaining other inks.

An object of the present teaching is to provide an ink-jet recording apparatus that is capable of accurately calculating a jetting amount of an ink.

An ink-jet recording apparatus, including: an ink-jet head including: a first nozzle from which a first ink is jetted; a second nozzle from which a second ink different from the first ink is jetted; a first drive element configured to apply energy to the first ink for jetting the first ink from the first nozzle; and a second drive element configured to apply energy to the second ink for jetting the second ink from the second nozzle, the first ink being supplied from a first ink tank, the second ink being supplied from a second ink tank; a power supply circuit configured to generate a drive voltage being commonly applied to the first drive element and the second drive element; and a controller configured to: estimate viscosity of the first ink in the first nozzle; control the power supply circuit to generate a first drive voltage in a case that the viscosity of the first ink in the first nozzle estimated is less than a threshold value; control the power supply circuit to generate a second drive voltage higher than the first drive voltage in a case that the viscosity of the first ink in the first nozzle estimated is equal to or more than the threshold value; drive the first drive element and the second drive element by the drive voltage generated in the power supply circuit, for jetting the first ink and the second ink front the first nozzle and the second nozzle respectively based on jetting instruction; and calculate a jetting amount of the first ink to be jetted from the first nozzle and a jetting amount of the second ink to be jetted from the second nozzle based on the jetting instruction, wherein the controller is configured to make a calculation such that a jetting amount of the second ink to be jetted from the second nozzle in a case that the second drive voltage is applied to the second drive element is larger, by a predefined amount, than a jetting amount of the second ink to be jetted from the second nozzle in a case that the first drive voltage is applied to the second drive element, and the predefined amount is an amount according to increase in a jetting amount based on the second drive voltage and the first drive voltage.

In the present teaching, when the viscosity of the first ink in the first nozzle becomes equal to or more than the threshold value, the drive voltage increases from the first drive voltage to the second drive voltage. This prevents jetting failure of the first ink which may otherwise be caused by the increase in viscosity of the first ink. When the drive voltage increases from the first drive voltage to the second drive voltage, a jetting amount of the second ink to be jetted from the second nozzle increases. The jetting amount of the second ink at the second drive voltage is thus calculated to be larger, by a predefined amount, than that at the first drive voltage. The predefined amount is an amount according to the increase in a jetting amount based on the second drive voltage and the first drive voltage. Accordingly, it is possible to enhance calculation accuracy of the jetting amount of the second ink.

BRIEF DESCRIPTION OF THE DRAWINGS

FIGS. 5A to 5D each depict a waveform diagram of a signal (a non-jetting signal or drive pulse signals) supplied from a driver IC to a piezoelectric actuator.

FIG. 6B is a liquid-droplet amount definition table, and FIG. 6C is a voltage sensitivity table.

DESCRIPTION OF THE EMBODIMENTS

Figure 1:
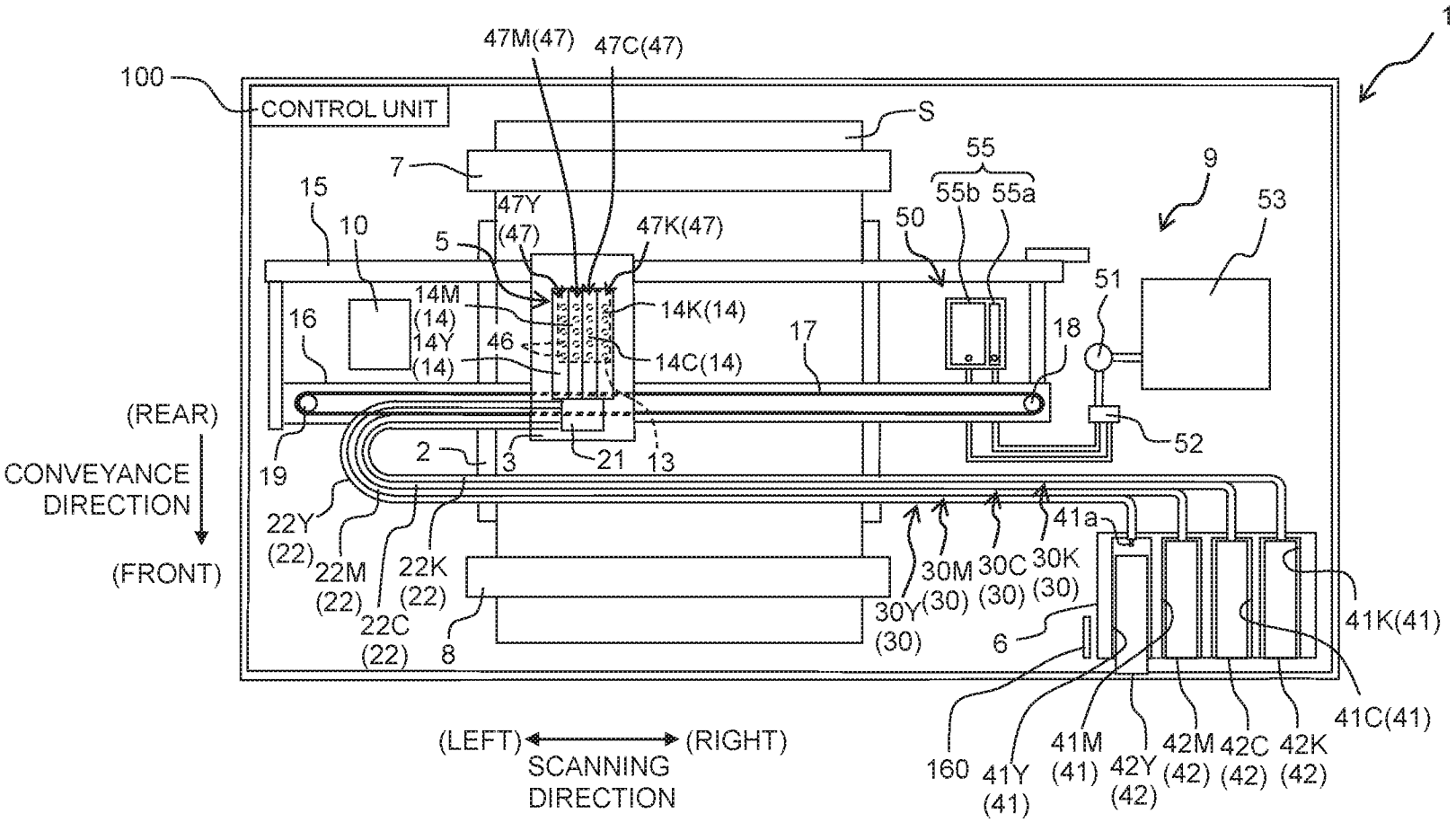
FIG. 1 schematically depicts a configuration of an ink-jet printer according to this embodiment.

A schematic configuration of an ink-jet printer 1 according to an embodiment of the present teaching is explained below. As depicted in FIG. 1, the printer 1 includes, for example, a platen 2, a carriage 3, an ink-jet head 5 (also simply referred to as a head 5), a holder 6, a feed roller 7, a discharge roller 8, a maintenance unit 9, a flushing receiver 10, a power circuit 60 (see FIG. 2), a temperature sensor 160, a touch panel 161 (see FIG. 2), and a control unit 100. In the following, a side of the front surface of FIG. 1 is defined as an upper side of the printer 1, and a side of the back surface of FIG. 1 is defined as a lower side of the printer 1. A front-rear direction and a left-right direction indicated in FIG. 1 are defined as a front-rear direction and a left-right direction of the printer 1. The following explanation is made based on those definitions.

A sheet S, which is a recording medium, is placed on an upper surface of the platen 2. Two guide rails 15 and 16 extending parallel to the left-right direction (scanning direction) are provided above the platen 2.

The carriage 3, which is attached to the two guide rails 15 and 16, is movable therealong in the left-right direction within an area facing the platen 2. A drive belt 17 is attached to the carriage 3. The drive belt 17 is an endless belt wound around two pulleys 18 and 19. The pulley 18 is coupled to a carriage drive motor 20 (see FIG. 2). Rotating and driving the pulley 18 by the carriage drive motor 20 causes the drive belt 17 to travel, reciprocatingly moving the carriage 3 in the left-right direction. The head 5 carried on the carriage 3 reciprocates in the left-right direction together with the carriage 3.

The holder 6 includes four cartridge installation sections 41 arranged in the left-right direction. Ink cartridges 42 are removably installed in the respective cartridge installation sections 41. The four ink cartridges 42 installed in the four cartridge installation sections 41 contain a black ink, a yellow ink, a cyan ink, and a magenta ink, respectively. In the following explanation, components of the ink-jet printer 1 corresponding to black (K), yellow (Y), cyan (C), and magenta (M) are assigned with alphabetic suffixes of "K" indicating black, "Y" indicating yellow, "C" indicating cyan, and "M" indicating magenta, respectively. For example, an ink cartridge 42K indicates one of the ink cartridges 42 containing the black ink. In this embodiment, the black ink is a pigment ink, and the remaining color inks (i.e., the yellow, cyan, and magenta inks) are dye inks.

Figure 3:
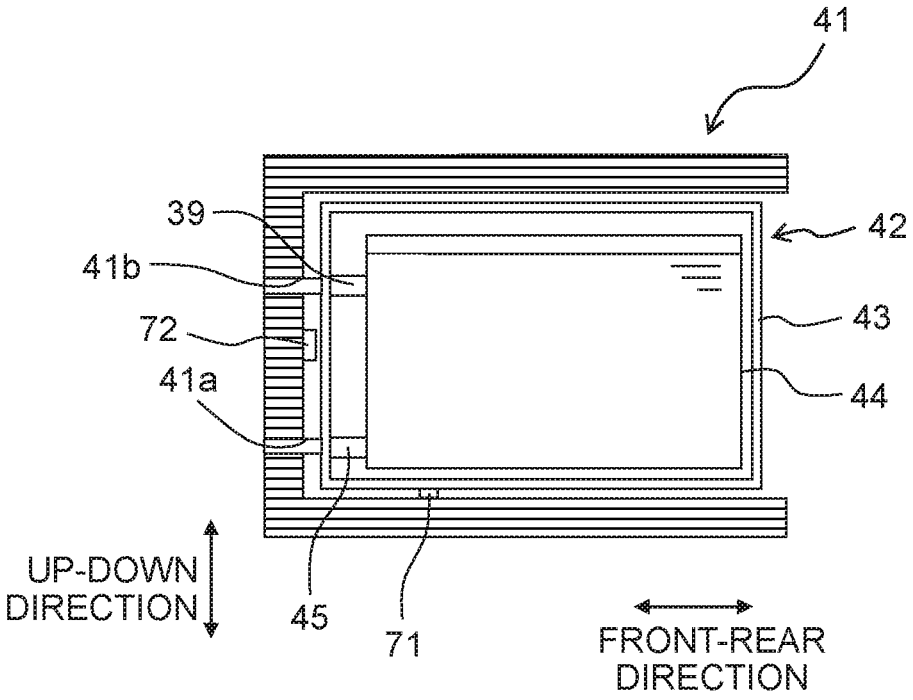
FIG. 3 is a cross-sectional view of side surfaces of an ink cartridge and a cartridge installation section, wherein the ink cartridge is installed in the cartridge installation section.

As depicted in FIG. 3, the ink cartridge 42 includes a casing 43 having substantially a rectangular parallelepiped shape, a storage chamber 44 having substantially a rectangular parallelepiped shape and containing the ink therein, a discharge pipe 45 connected to a lower portion of the storage chamber 44, and an atmosphere communicating part 39 connected to the storage chamber 44.

The discharge pipe 45 defines a channel for supplying the ink stored in the storage chamber 44 to the outside of the ink cartridge 42. The cartridge installation section 41 includes a needle 41*a* that is connected to the discharge pipe 45 to let the ink run when the ink cartridge 42 is installed in the cartridge installation section 41.

The atmosphere communicating part 39 includes a channel for allowing the storage chamber 44 to communicate with the outside of the ink cartridge 42, a valve provided in the channel, and the like. The valve opens when the ink cartridge 42 is installed in the cartridge installation section 41, allowing the storage chamber 44 to communicate with the atmosphere via an atmosphere communicating channel 41*b* of the cartridge installation section 41.

The cartridge installation section 41 includes an installation detection sensor 71 configured to detect that the ink cartridge 42 is installed in the cartridge installation section 41 and an optical sensor 72 configured to detect that a residual amount of ink stored in the ink cartridge 42 is equal to or less than a predefined amount (for example, near empty).

As depicted in FIG. 1, the head 5 is carried on the carriage 3. The head 5 includes a head body 13 and four sub tanks 14 (14K, 14Y, 14M, and 14C). The four sub tanks 14 are arranged in the left-right direction. The four sub tanks 14 are provided with a common tube joint 21. The tube joint 21 is removably connected to first ends of four flexible ink supply tubes 22 (22K, 22Y, 22M, and 22C). Second ends of the four ink supply tubes 22 are connected to the needles 41*a* of the four cartridge installation sections 41 (41K, 41Y 41M, and 41C) of the holder 6, respectively. The inks in the four ink cartridges 42 installed in the cartridge installation sections 41 are supplied to the four sub tanks 14 via the four ink supply tubes 22, respectively.

The head body 13 is attached to lower portions of the four sub tanks 14. A lower surface of the head body 13 is a nozzle surface with nozzles 46 through which the inks are jetted. In the nozzle surface, the nozzles 46 are aligned in the front-rear direction to form four nozzle rows 47 arranged in the left-right direction. The four nozzle rows 47 include a nozzle row 47Y through which the yellow ink is jetted, a nozzle row 47M through which the magenta ink is jetted, a nozzle row 47C through which the cyan ink is jetted, and a nozzle row 47K through which the black ink is jetted. Details of the head body 13 are described below.

The feed roller 7 and the discharge roller 8 are driven by a conveying motor 29 (see FIG. 2) to rotate synchronously to each other. The feed roller 7 and the discharge roller 8 cooperate to convey the sheet S placed on the platen 2 frontward (in a conveyance direction).

The printer 1 prints a desired image or the like on the sheet S by jetting the ink(s) during the movement of the head 5 and the carriage 3 in the left-right direction (scanning direction) while conveying the sheet S in the conveyance direction by use of the feed roller 7 and the discharge roller 8. Namely, the printer 1 of this embodiment is an ink-jet printer of a serial system.

The flushing receiver 10 is disposed on a left side of the platen 2. The nozzles 46 face the flushing receiver 10 in an up-down direction in a state where the head 5 carried on the carriage 3 is in a flushing position. With the head 5 being in the flushing position, the printer 1 causes the head 5 to perform flushing, by which the inks are discharged from the nozzles 46 to the flushing receiver 10, based on flushing data (exemplary jetting instruction).

The maintenance unit 9 is provided to perform a maintenance operation for maintaining and recovering jetting performance of the head 5. The maintenance unit 9 includes a cap unit 50, a suction pump 51, a switching device 52, a waste liquid tank 53, and the like.

The cap unit 50 is disposed on a right side of the platen 2. When the carriage 3 moves rightward beyond the platen 2, the nozzles 26 face the cap unit 50 in the up-down direction. Further, the cap unit 50 is driven by a cap moving motor 24 (see FIG. 2) to be ascendable (liftable) and descendable in the up-down direction (movable in the up-down direction). The cap unit 50 includes a cap 55 that is installable in the head 5 by coming into contact therewith. The cap 55, which is made using a rubber material or the like, has a black cap 55*a* and a color cap 55*b*.

The cap 55 faces the lower surface of the head body 13 in a state where the carriage 3 faces the cap unit 50. Lifting the cap unit 50 in the state where the carriage 3 faces the cap unit 50 causes the cap unit 50 to be installed in the head 5. In that situation, the nozzle row 47K is covered with the black cap 55*a*, and the three nozzle rows 47Y, 47M and 47C are covered collectively with the color cap 55*b*.

The black cap 55*a* and the color cap 55*b* are connected to the suction pump 51 via the switching device 52. The switching device 52 selectively switches a connection destination of the suction pump 51 between the black cap 55*a* and the color cap 55*b*. The waste liquid tank 53 is connected to the suction pump 51 in a portion thereof on a side opposite to another portion of the suction pump 51 closer to the switching device 52.

The printer 1 causes the maintenance unit 9 to perform a suction purge. The suction purge is the maintenance operation controlled by the control unit 100 to forcibly discharge the inks from the nozzles 46.

Specifically, in a case of performing the suction purge by which the black ink is forcibly discharged from the nozzles 46K belonging to the nozzle row 47K, the suction pump 51 is driven in a state where the nozzle row 47K is covered with the black cap 55*a* and where the black cap 55*a* communicates with the suction pump 51. This makes the pressure inside the black cap 55*a* negative, forcibly discharging the black ink from the nozzles 46K belonging to the nozzle row 47K.

Similarly, in a case of performing the suction purge by which the color inks are forcibly discharged from the nozzles 46Y, 46M, and 46C belonging to the nozzle rows 47Y, 47M, and 47C, the suction pump 51 is driven in a state where the nozzle rows 47Y, 47M, and 47C are covered with the color cap 55*b* and where the color cap 55*b* communicates with the suction pump 51.

Figure 2:
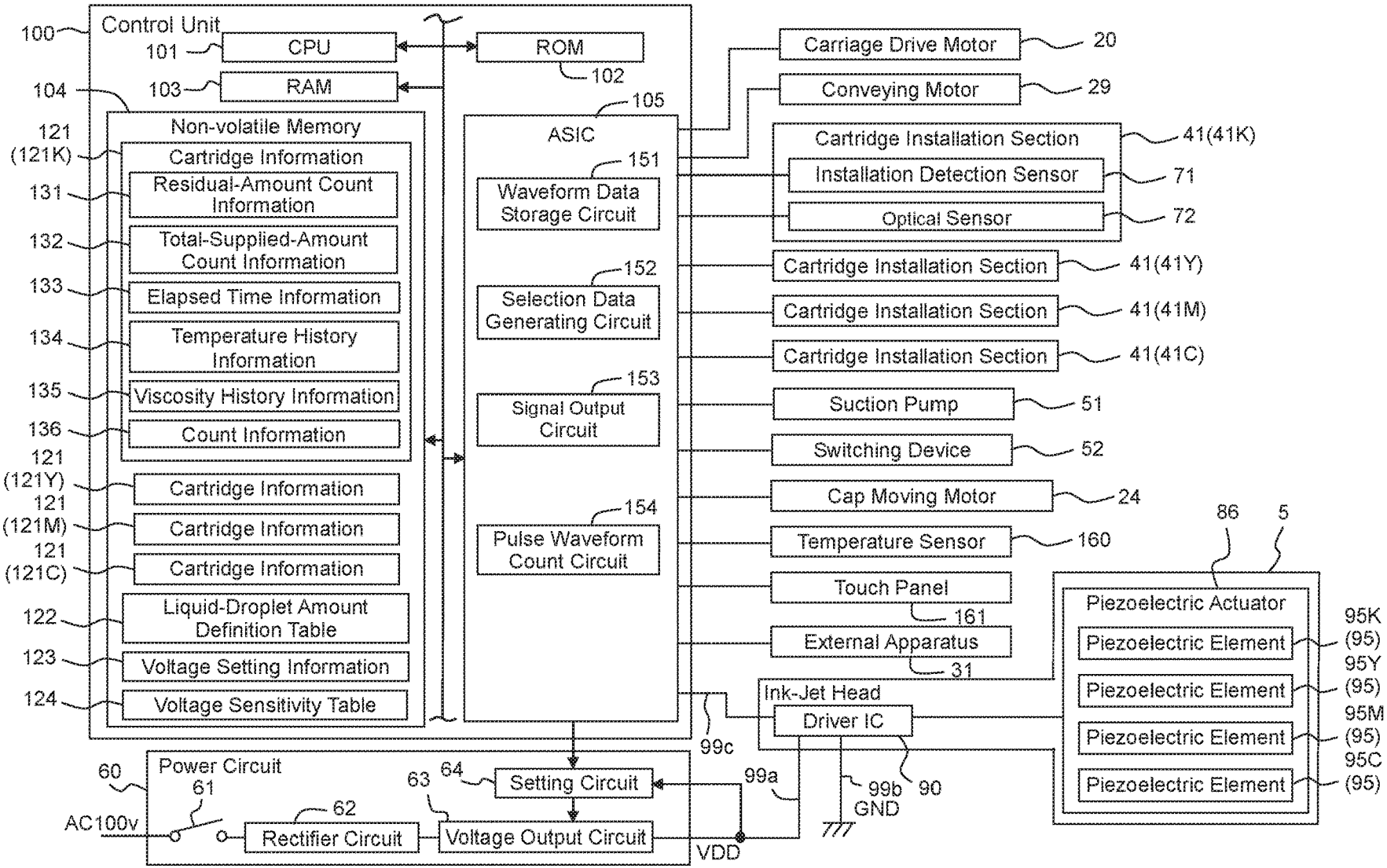
FIG. 2 is a block diagram schematically depicting an electrical configuration of the ink-jet printer.

As depicted in FIG. 2, the power circuit 60 includes a power switch 61, a rectifier circuit 62, a voltage output circuit 63, a setting circuit 64, and the like. The power switch 61 performs connection/disconnection with an AC power source of 100V. The rectifier circuit 62 converts an alternate current supplied from the AC power source to a direct current. In that case, the rectifier circuit 62 lowers the voltage from 100V to a voltage lower than 100V (for example, a voltage of about 30V). The direct current voltage from the rectifier circuit 62 is supplied to the voltage output circuit 63. The voltage output circuit 63 generates and outputs an output voltage (VDD) for driving various drive units forming the printer 1, such as a driver IC 90 described below. The voltage output circuit 63 has a switching function by which the generated output voltage is supplied or not supplied to each of the drive units. The setting circuit 64 is a PWM circuit configured to set a control target value used for feedback control in the voltage output circuit 63, thus maintaining the output voltage at a predefined voltage. The power circuit 60 is configured to output voltages in multiple levels.

The temperature sensor 160 is disposed in the vicinity of the holder 6 to measure ambient temperature.

The control unit 100 includes, for example, a Central Processing Unit (CPU) 101, a Read Only Memory (ROM) 102, a Random Access Memory (RAM) 103, a non-volatile memory 104, and an Application Specific Integrated Circuit 105. The ROM 102 stores programs executed by the CPU 101, various kinds of fixed data, and the like. The RAM 103 temporarily stores data (printing data, flushing data, and the like) required for executing the programs. The ASIC 105 is connected to various devices or drive units of the printer 1, such as the head 5 and the carriage drive motor 20. The ASIC 105 is connected to an external apparatus 31, such as a PC.

The control unit 100 controls, based on a printing command received from the external apparatus 31, the head 5, the carriage drive motor 20, and the like to perform print processing in which an image or the like is printed on the sheet S. In this embodiment, the print processing includes a first print mode and a second print mode. In the first print mode, printing is performed by using at least the black ink. In the second print mode (e.g., a mode for photo printing), printing is performed by using the color ink(s) only.

In this embodiment, various kinds of processing executed by the control unit 100, such as the print processing, may be executed by the single CPU, or the CPU and ASIC operating in cooperation with each other. The control unit 100 may include multiple CPUs to make the CPUs perform processing in a shared manner. The control unit 100 may include multiple ASICs to make the ASICs perform processing in a shared manner. The single ASIC may execute processing.

Figure 4A:
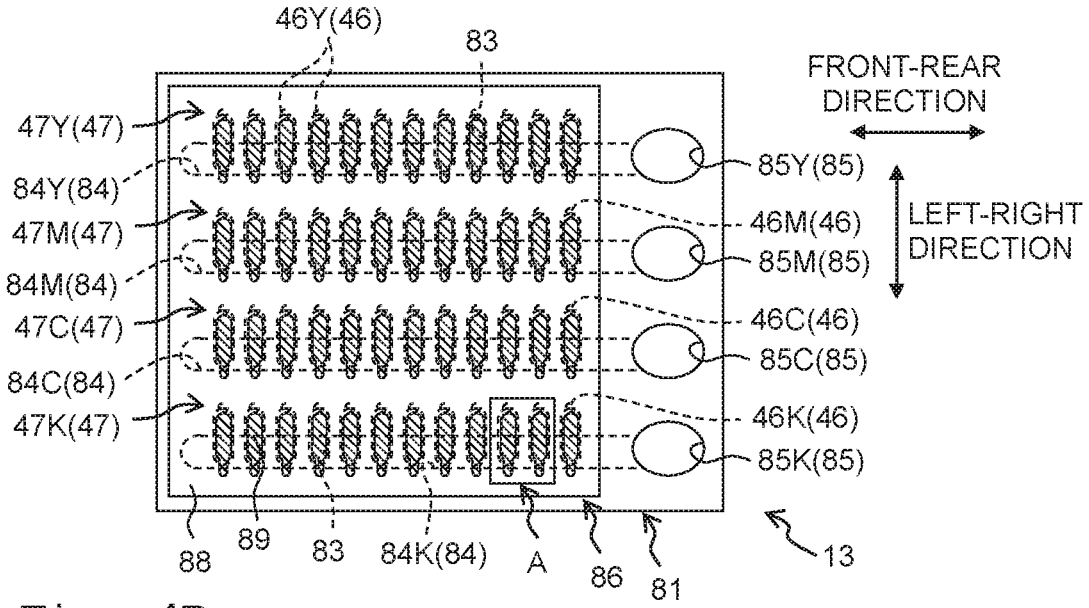
FIG. 4A is a plan view of a head body.

Subsequently, the head body 13 is explained in detail. As depicted in FIG. 4A, the head body 13 includes a channel structure 81 and a piezoelectric actuator 86. The channel structure 81 includes the nozzles 46 and pressure chambers 83 respectively communicating with the nozzles 46. The piezoelectric actuator 86 is disposed on an upper surface of the channel structure 81.

Figure 4B:
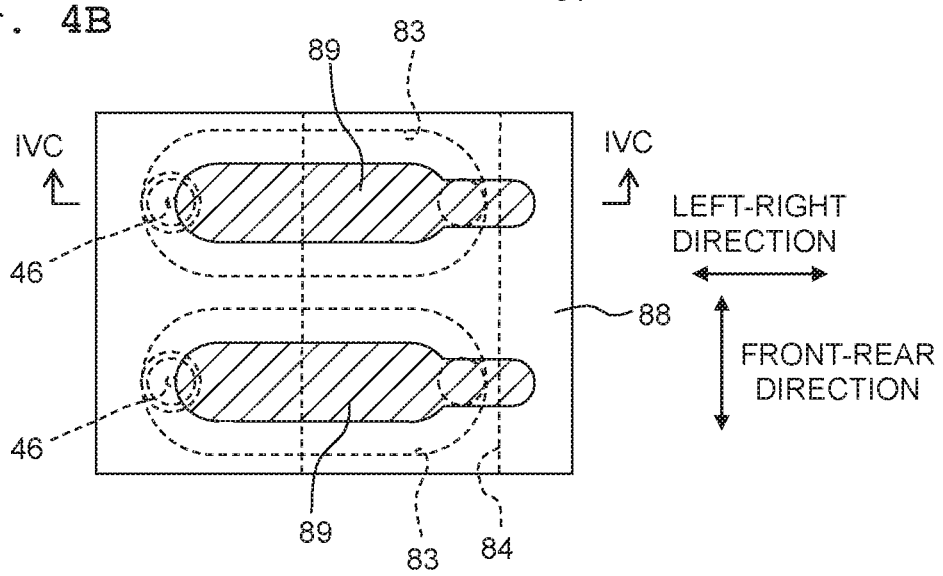
FIG. 4B is an enlarged view of an A portion in FIG. 4A.
Figure 4C:
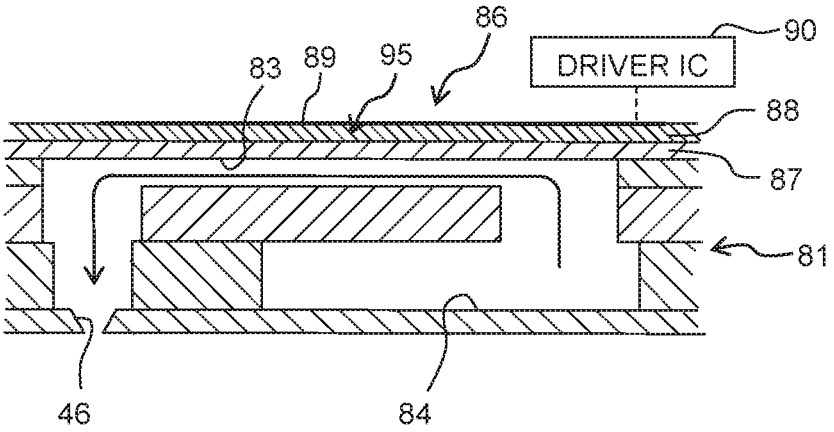
FIG. 4C is a cross-sectional view taken along a line IVC-IVC in FIG. 4B.

As depicted in FIG. 4C, the channel structure 81 has a laminated structure of four plates. Each of the nozzles 46 is open in a lower surface of the channel structure 81. As depicted in FIG. 4A, the nozzles 46 are aligned in the front-rear direction (the conveyance direction of the sheet S) to form the four nozzle rows 47 corresponding to the inks of four colors. Similar to the nozzles 46, the pressure chambers 83 are aligned in the front-rear direction to form four pressure-chamber rows.

As depicted in FIGS. 4A and 4B, the channel structure 81 includes four manifolds 84 (84K, 84Y, 84M, and 84C) extending in the front-rear direction. The inks of four colors are supplied to the four pressure-chamber rows via the four manifolds 84, respectively. The four manifolds 84 are respectively connected to four ink supply holes (85K, 85Y, 85M, and 85C) formed on the upper surface of the channel structure 81. The inks of four colors are supplied from the four sub tanks 14 (see FIG. 1) to the four ink supply holes 85. Accordingly, the channel structure 81 includes individual channels, each of which branches from one of the manifolds 84 and reaches each nozzle 46 via the corresponding pressure chamber 83.

As depicted in FIG. 4C, the piezoelectric actuator 86 includes a vibration plate 87 covering the pressure chambers 83, a piezoelectric layer 88 disposed on an upper surface of the vibration plate 87, and individual electrodes 89 respectively corresponding to the pressure chambers 83. The individual electrodes 89 on an upper surface of the piezoelectric layer 88 are electrically connected to the driver IC 90 driving the piezoelectric actuator 86. As depicted in FIG. 2, the driver IC 90 is connected to wiring lines, such as a power supply line 99*a*, a ground wiring line 99*b*, and a control signal line 99*c*. The output voltage generated in the power circuit 60 is supplied to the driver IC 90 through the power supply line 99*a*. The driver IC 90 is connected to the ground through the ground wiring line 99*b*. Control signals, such as pulse waveform data and waveform selection data, are inputted from the control unit 100 to the driver IC 90 through the control signal line 99*c*.

The vibration plate 87 on a lower surface of the piezoelectric layer 88 is made using a metal material. The vibration plate 87, which is disposed to face individual electrodes 89 while sandwiching the piezoelectric layer 88 therebetween, functions as a common electrode. The vibration plate 87 is connected to the ground wiring line 99*b* of the driver IC 90, allowing the vibration plate 87 to be constantly kept at a ground potential.

In the above configuration, a piezoelectric element 95 (see FIG. 4C) is formed by the single individual electrode 89, a portion, of the vibration late 87 as the common electrode, facing the single pressure chamber 83, and a portion, of the piezoelectric layer 88, facing the single pressure chamber 83.

The driver IC 90 outputs, based on a control signal from the control unit 100, a drive pulse signal to the individual electrode 89 of each piezoelectric element 95, switching a voltage to be applied to the individual electrode 89 between a high level (a level of output voltage transmitted from the power circuit 60 via the power supply line 99*a*) and a low level (a ground level). In this embodiment, the output voltage outputted from the power circuit 60 is applied commonly to the piezoelectric elements 95.

The operation of the piezoelectric actuator 86 for jetting the ink from the nozzle 46 is as follows. The driver IC 90 switches the voltage of the individual electrode 89 of one piezoelectric element 95 from the low level to the high level. This generates an electrical potential difference between the individual electrode 89 and the vibration plate 87 as the common electrode, causing piezoelectric deformation in the piezoelectric layer 88 sandwiched between the individual electrode 89 and the vibration plate 87. The piezoelectric deformation in the piezoelectric layer 88 causes the change in volume of the piezoelectric chamber 83, applying pressure (energy) to the ink in the piezoelectric chamber 83 (the nozzle 46). This causes jetting of a liquid droplet of the ink from the nozzle 46 communicating with the pressure chamber 83.

In the following, for the sake of explanatory convenience, an entire channel ranging from the needle 41*a* to the nozzles 46 as depicted in FIG. 1 is collectively referred to as an ink channel 30 (30K, 30Y, 30M, and 30C).

Subsequently, details of an electrical configuration for driving the piezoelectric actuator 86 are explained. A configuration of the driver IC 90 that supplies the drive pulse signal to the piezoelectric actuator 86 is explained first.

Figure 5A:
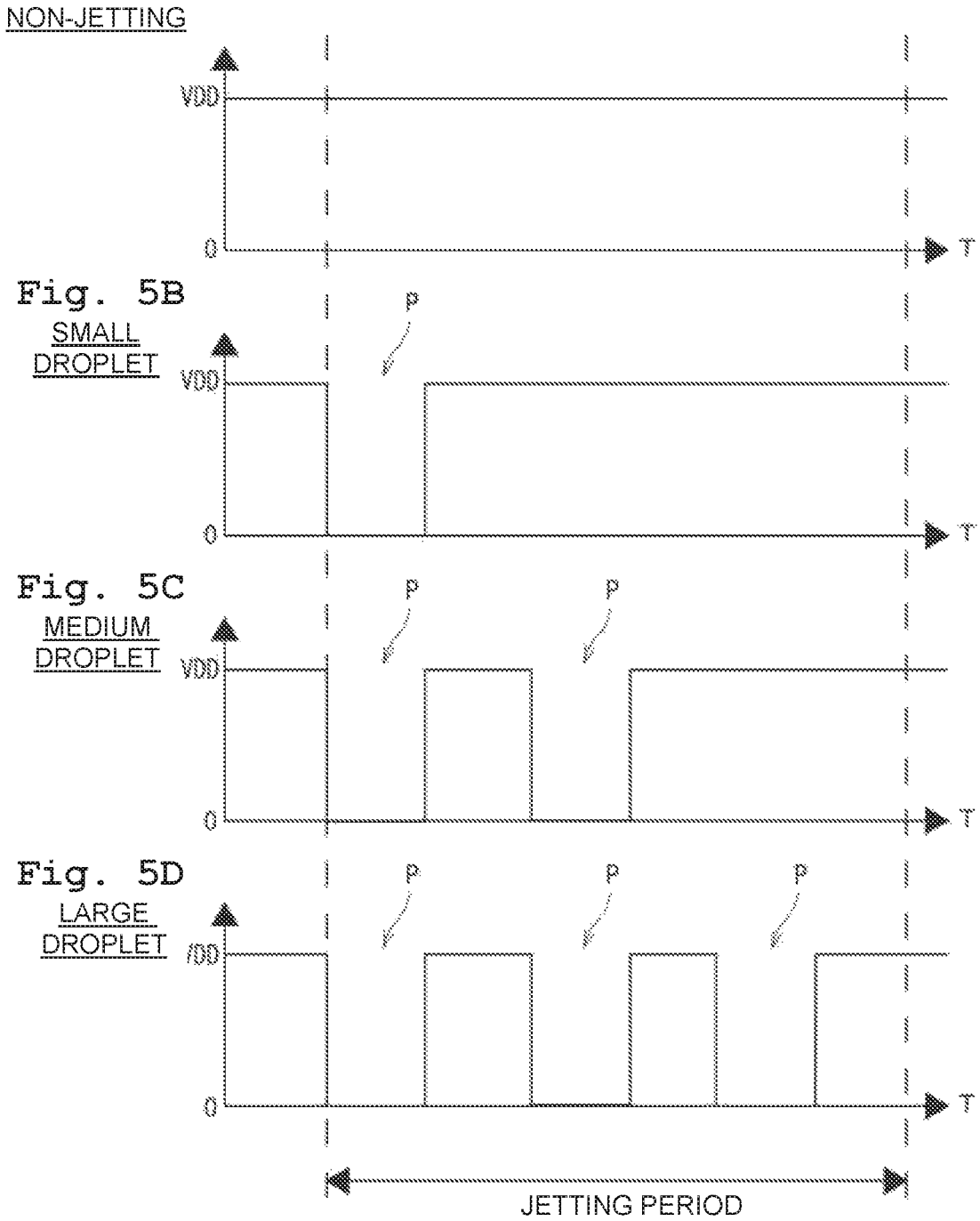

The driver IC 90 selects one of four kinds of signals depicted in FIGS. 5A to 5D to supply the one to the individual electrode 89 of the piezoelectric element 95 during each jetting period (a period during which one dot is formed on the sheet S). One (FIG. 5A) of the four kinds of signals is a non-jetting signal having no drive pulse P. The remaining three kinds of signals (FIGS. 5B to 5D) are drive pulse signals having mutually different pulse waveforms. Three kinds of liquid droplets having mutually different sizes (a small droplet, a medium droplet, and a large droplet) are jetted from the nozzle 46 by using the three kinds of signals to enable multi-gradation printing or multi-tone printing. More specifically, as depicted in FIGS. 5B to 5D, the three kinds of drive pulse signals have mutually different numbers of the drive pulses P included in one jetting period. The driver IC 90 selects one of the four kinds of signals depicted in FIGS. 5A to 5D based on the waveform selection data transmitted from the control unit 100 to output the one to the individual electrode 89 of each piezoelectric element 95.

Figure 6A:
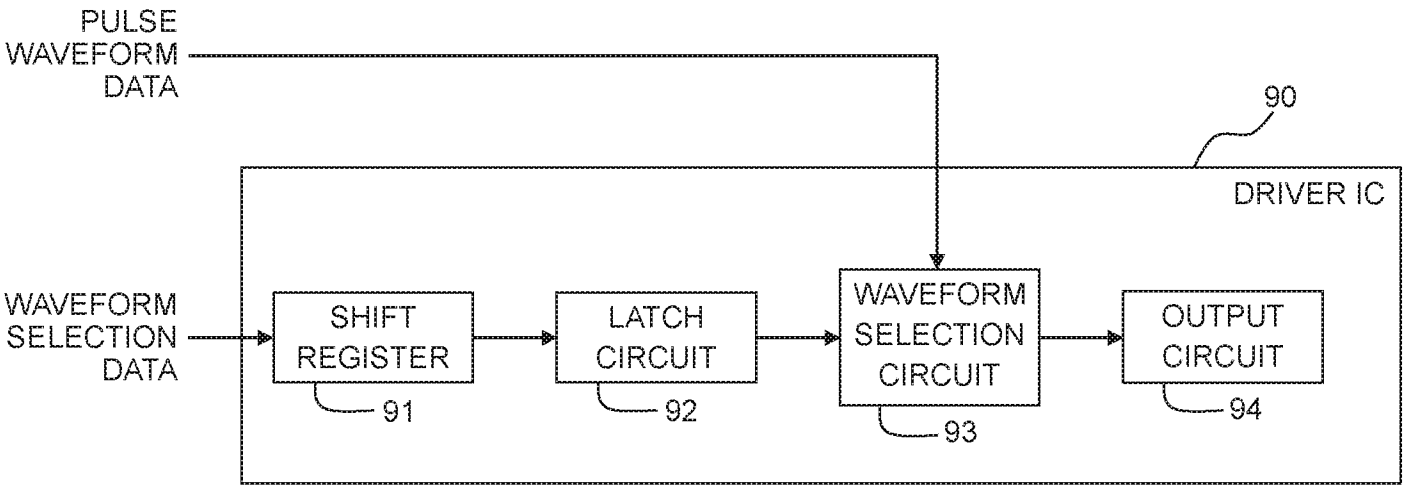
FIG. 6A is a block diagram schematically depicting a circuit configuration of the driver IC.

As depicted in FIG. 6A, the driver IC 90 includes a shift resistor 91, a latch circuit 92, a waveform selection circuit 93, and an output circuit 94. The waveform selection data corresponding to each of the piezoelectric elements 95 is inputted from the control unit 100 to the shift resistor 91. The waveform selection data corresponding to one of the piezoelectric elements 95 is bit data of several bits, which allows the waveform selection circuit 93 to select one of the four kinds of signals depicted in FIGS. 5A to 5D. The total number of bits of the pieces of waveform selection data corresponding to the piezoelectric elements 95 in one jetting period is acquired by (the number of bits of a piece of waveform selection data)×(the total number of the piezoelectric elements 95). The pieces of bit data are serially inputted from the control unit 100 to the driver IC 90.

The shift resistor 91 executes parallel conversion on the above pieces of bit data inputted serially and sequentially outputs the parallel data to the latch circuit 92. The latch circuit 92 holds the pieces of bit data (the pieces of waveform selection data) outputted in parallel from the shift resistor 91, until input of all the pieces of data related to one jetting period is completed. When the input of all the pieces of the waveform selection data is completed, the latch circuit 92 parallelly outputs the pieces of waveform selection data held therein, to the waveform selection circuit 93.

The pieces of pulse waveform data of the four kinds of signals depicted in FIGS. 5A to 5D are inputted from the control unit 100 to the waveform selection circuit 93. The waveform selection circuit 93 selects one of the four kinds of signals based on the pieces of waveform selection data that correspond to the individual electrodes 89 and are inputted from the latch circuit 92, and outputs the one to the output circuit 94.

The waveform signal to be outputted from the waveform selection circuit 93 is a signal having a control voltage level of a logic circuit, such as the shift resistor 91, the latch circuit 92, and the waveform selection circuit 93. The output circuit 94 amplifies the waveform signal inputted from the waveform selection circuit 93 to a voltage level corresponding to the output voltage outputted from the power circuit 60, generating the drive pulse signal. Then, the output circuit 94 outputs the drive pulse signal to the individual electrode 89 of the piezoelectric element 95.

Subsequently, a configuration of the ASIC 105 of the control unit 100 for driving the piezoelectric actuator 86 is explained. As depicted in FIG. 2, the ASIC 105 includes a waveform data storing circuit 151, a waveform selection data generating circuit 152, and a signal output circuit 153. The waveform data storing circuit 151 stores data (pulse waveform data) related to the pulse waveforms of the four kinds of signals depicted in FIGS. 5A to 5D. The waveform selection data generating circuit 152 generates, based on printing data (exemplary jetting instruction) transmitted from the external apparatus 31, pieces of waveform selection data for the respective piezoelectric elements 95 to select one of the four kinds of pulse waveforms depicted in FIGS. 5A to 5D.

The signal output circuit 153 outputs the pulse waveform data stored in the waveform data storing circuit 151 and the waveform selection data generated in the waveform selection data generating circuit 152 to the driver IC 90. Upon receiving the pulse waveform data and the waveform selection data, the driver IC 90 generates drive pulse signals having a voltage level that corresponds to the output voltage generated in the power circuit 60, for the respective piezoelectric elements 95, and supplies the drive pulse signals to the respective piezoelectric elements 95. Driving the piezoelectric actuator 86 as described above jets the ink from the nozzles 46.

As described above, the CPU 101 determines, by use of the optical sensor 72 provided in the cartridge installation section 41, whether the residual amount of the ink in each ink cartridge 42 is equal to or less than the predefined amount (near empty). However, whether the residual amount of the ink in each ink cartridge 42 is zero (empty) can not be determined by using only the optical sensor 72.

When the ink is jetted from the nozzle 46 in the print processing or the like in a state where the residual amount of the ink in the ink cartridge 42 is zero, air in the ink cartridge 42 enters the ink channel 30 by a jetting amount of the ink. The air entering the ink channel 30 may cause ink jetting failure and the like. In order to prevent that problem, a message informing a user of the need for replacement of the ink cartridge 42 may be displayed on the touch panel 161 when the optical sensor 72 detects that the residual amount of the ink in the ink cartridge 42 is equal to or less than the predefined amount. In this case, however, the ink cartridge 42 may be replaced with a new cartridge even though the ink is remained in the ink cartridge 42.

Thus, in this embodiment, when the print processing is executed after the optical sensor 72 detects that the residual amount of the ink in the ink cartridge 42 is equal to or less the predefined amount, jetting-amount calculation processing is executed. In the jetting-amount calculation processing, the jetting amount of the ink jetted in the print processing is calculated for each of the ink colors based on the printing data. Then, residual-amount estimation processing is executed to estimate the residual amount of the ink in each ink cartridge 42 based on the calculation result of the jetting-amount calculation processing. Details are described below.

As depicted in FIG. 2, the ASIC 105 further includes a pulse waveform count circuit 154. The pulse waveform count circuit 154 counts the number of times of generation of the waveform selection data, which is generated in the waveform selection generation circuit 152 to be used for selection of the pulse waveform, for each of the ink colors, and then outputs count information thereof to the CPU 101. Namely, the pulse waveform count circuit 154 counts the number of times of output of each of the four kinds of signals depicted in FIGS. 5A to 5D from the driver IC 90, for each of the ink colors.

The non-volatile memory 104 stores a liquid-droplet amount definition table 122 (see FIG. 6B) defining the amount of liquid droplet of the ink that is jetted from the nozzle 46 when each of the three kinds of drive pulse signals (the small droplet, medium droplet, and large droplet) is outputted to the piezoelectric element 95. The defined liquid-droplet amount defined in the liquid-droplet amount definition table 122 corresponds to a liquid droplet amount when a normal voltage is outputted from the power circuit 60. In other words, the pulse waveform of each of the drive pulse signals is determined so that the ink is jetted from the nozzle 46 by an amount defined in the liquid-droplet amount definition table 122 when the normal voltage is outputted from the power circuit 60.

In the jetting-amount calculation processing, the CPU 101 refers to the liquid-droplet amount definition table 122 to calculate the jetting amount of the ink jetted in the print processing for each of the ink colors based on the count information outputted from the pulse waveform count circuit 154. Namely, the jetting amount of the ink is calculated for each of the ink colors based on the count information outputted from the pulse waveform count circuit 154 on the premise that the amount of the liquid droplet to be jetted from the nozzle 46 per one output of each drive pulse signal to the piezoelectric element 95 corresponds to the defined liquid-droplet amount.

The non-volatile memory 104 stores four pieces of cartridge information 121 (121K, 121Y, 121M, and 121C) corresponding to the four ink cartridges 42. Each piece of cartridge information 121 includes residual-amount count information 131 indicating the residual amount of the ink in the ink cartridge 42. An initial value of a count value of the residual-amount count information 131 is the predefined amount that is the residual amount of ink in the ink cartridge 42 in a state of the near empty. After the optical sensor 72 detects that the residual amount of the ink having any of the four colors in the ink cartridge 42 is equal to or less than the predefined amount, the CPU 101 subtracts the ink jetting amount calculated in the jetting-amount calculation processing from the count value of the residual-amount count information 131 each time executing the jetting-amount calculation processing.

Besides the print processing, there may be processing in which each ink is supplied from the ink cartridge 42 to the ink channel 30, such as the flushing and suction purge. In those cases also, the CPU 101 calculates the supply amount of each ink and subtracts the supply amount calculated from the count value of the residual-amount count information 131. The supply amount in the flushing may be calculated by a method similar to the jetting-amount calculation processing. The supply amount in the suction purge may be calculated based on rotation speed and drive time of the suction pump 51.

Accordingly, referring to the count value of the residual-amount count information 131 of each piece of cartridge information 121 allows the CPU 101 to accurately acquire the residual amount of the ink in each ink cartridge 42 and to accurately determine the timing at which the residual amount of the ink is zero.

When the ink cartridge 42K storing the black pigment ink is left stationary for a long time, the jetting failure of black ink may occur in the head 5. Details thereof are explained below.

In the pigment ink, the pigment is dispersed in a solvent. When the pigment ink is left stationary for a long time, the pigment of which specific gravity is large falls on the bottom of the ink cartridge 42. Thus, when the ink cartridge 42K containing the black pigment ink is left stationary for a long time, a large amount of the pigment falls on the bottom of the ink cartridge 42K. This locally increases a pigment concentration of the pigment ink on the bottom of the ink cartridge 42, thus locally increasing a viscosity thereof. When the viscous pigment ink is supplied to the nozzle 46K, the viscosity of the ink in the nozzle 46K may become equal to or higher than a threshold value. In that case, the black ink may not be jetted from the nozzle 46K by a desired amount, or no black ink may not be jetted from the nozzle 46K even when the drive pulse signal having the voltage level that corresponds to the normal voltage is outputted to the piezoelectric element 95K corresponding to black ink.

Unlike the pigment ink, constituents of the dye ink hardly fall. Thus, even when the ink cartridges 42Y, 42M, and 42C containing the dye inks are left stationary for a long time, viscosities of the dye inks do not locally rise on the bottoms of the ink cartridges 42Y, 42M, and 42C. The viscosities of the inks in the nozzles 46Y, 46M, and 46C thus hardly become equal to or higher than the threshold value.

As described above, when the ink cartridge 42K containing the black pigment ink is left stationary for a long time, the jetting failure of black ink may occur in the head 5. Thus, in this embodiment, the CPU 101 executes processing of estimating ink viscosity in a nozzle (hereinafter referred to as in-nozzle ink viscosity estimation processing) for estimating the viscosity of the ink in the nozzle 46K, after receiving the printing command and before executing the print processing. When the viscosity of the ink in the nozzle 46K estimated by the in-nozzle ink viscosity estimation processing is equal to or more than the threshold value, power supply processing is executed. In the power supply processing, a high voltage higher than the normal voltage is outputted from the power circuit 60. This increases the voltage level of the drive pulse signal to be outputted to the piezoelectric element 95K, increasing jetting energy to be applied to the ink in the nozzle 46K. As a result, it is possible to jet the black ink from the nozzle 46K by the desired amount.

Subsequently, the power supply processing is explained in detail. When the viscosity of the ink in the nozzle 46K estimated is equal to or more than the threshold value, the CPU 101 sets the voltage value of the high voltage to be outputted from the power circuit 60 as follows. Namely, the voltage value of the high voltage to be outputted from the power circuit 60 is set so that the difference between the defined liquid-droplet amount which is the liquid droplet amount of each drive pulse signal defined in the liquid-droplet amount definition table 122 and a liquid droplet amount under high voltage which is a liquid droplet amount of the ink to be jetted from the nozzle 46K when each drive pulse signal having the voltage level that corresponds to the voltage Value of the high voltage is applied to the piezoelectric element 95K is within a predefined ratio (e.g., 3% or less) relative to the defined liquid-droplet amount. For example, it is assumed that the defined liquid-droplet amount of the drive pulse signal for the small droplet defined in the liquid-droplet amount definition table 122 is a liquid droplet amount A. Further, it is assumed that the liquid droplet amount under high voltage of the ink to be jetted from the nozzle 46K when the viscosity of the ink in the nozzle 46K is equal to or more than the threshold value and when the drive pulse signal for the small droplet having the voltage level that corresponds to the voltage value of the high voltage is outputted to the piezoelectric element 95K is a liquid droplet amount A'. The voltage value of the high voltage to be outputted from the power circuit 60 is set so that the difference between the liquid droplet amount A and the liquid droplet amount A' (=A−A') is within the predefined ratio relative to the liquid droplet amount A.

Here, the jetting amount of the black ink that is jotted from the nozzle 46K when the viscosity of the ink in the nozzle 46K is less than the threshold value and when the drive pulse signal having the voltage level that corresponds to the normal voltage is outputted to the piezoelectric element 95K is defined as a first jetting amount, and the jetting amount of the black ink that is jetted from the nozzle 46K when the viscosity of the ink in the nozzle 46K is equal to or more than the threshold value and when the drive pulse signal having the voltage level that corresponds to the high voltage is outputted to the piezoelectric element 95K is defined as a second jetting amount. The difference between the first jetting amount and the second jetting amount is within the predefined ratio relative to the first jetting amount. As a result, even when the viscosity of the ink in the nozzle 46K becomes equal to or higher than the threshold value, the ink is jetted by an amount which is substantially the same as that of when the viscosity of black ink is less than the threshold value.

In the multiple kinds of the drive pulse signals according to this embodiment, the voltage value of the high voltage to be outputted from the power circuit 60 is set so that the liquid droplet amount under high voltage is smaller than the defined liquid-droplet amount. Namely, the voltage value of the high voltage to be outputted from the power circuit 60 is set so that the second jetting amount is smaller than the first jetting amount. This prevents the ink residual amount in the ink cartridge 42K indicated by the count value of the residual-amount count information 131 of the cartridge information 121K from being larger than an actual residual amount. As a result, air is prevented from entering the ink channel 30 from the ink cartridge 42K.

Although the pigment may fall in the ink channel 30K (e.g., in the sub tank 14K), the fall amount of the pigment is much smaller than that in the ink cartridge 42K. The increase in viscosity due to the pigment fall occurs mainly in the ink cartridge 42K. In this embodiment, in order to improve the estimation accuracy, the CPU 101 first executes processing of estimating an ink viscosity in a cartridge (hereinafter referred to as in-cartridge ink viscosity estimation processing) that is included in the in-nozzle ink viscosity estimation processing. In the in-cartridge ink viscosity estimation processing, the CPU 101 estimates the viscosity of the ink in the lower portion of the storage chamber 44 of the ink cartridge 42K, that is, the viscosity of the ink in a connection portion (hereinafter referred to as a discharge-pipe connection portion) between the storage chamber 44 and the discharge pipe 45. The viscosity of the ink in the nozzle 46K is estimated by using the viscosity of the ink in the discharge-pipe connection portion that is estimated in the in-cartridge ink viscosity estimation processing. Details of the in-cartridge ink viscosity estimation processing are explained below.

The fall amount of the pigment falling in the ink cartridge 42K is larger as a period during which the ink cartridge 42K is kept stationary is longer. The fall amount of the pigment falling in the ink cartridge 42K is larger as frequency of ink supply from the ink cartridge 42K to the ink channel 30 is smaller. Further, the viscosity of the pigment ink decreases as the temperature in the ink cartridge 42 is higher. This facilitates the pigment fall.

In order to solve that problem, as depicted in FIG. 2, the cartridge information 121K of the non-volatile memory 104 has total-supply-amount count information 132, elapsed time information 133, and temperature history information 134.

The total-supply-amount count information 132 is count information indicating a supply amount of the ink supplied from the ink cartridge 42K to the ink channel 30 from installation detection timing at which the installation detection sensor 71 detects the installation of the ink cartridge 42K in the cartridge installation section 41K. Every time the ink is supplied from the ink cartridge 42K to the ink channel 30 in the print processing, flushing, suction purge, or the like, the CPU 101 calculates the ink supply amount and adds the supply amount calculated to the count value of the total-supply-amount count information 132.

The elapsed time information 133 is information indicating elapsed time from the installation detection timing. After the installation detection timing, the elapsed time information 133 is sequentially updated by an internal clock of the control unit 100. The temperature history information 134 is history information of the temperature, which is measured by the temperature sensor 160 from the installation detection timing. Every time the internal clock clocks a certain period of time, the CPU 101 adds the temperature measured by the temperature sensor 160 to the temperature history information 134.

In the in-cartridge ink viscosity estimation processing, the CPU 101 estimates the pigment fall amount based on the total-supply-amount count information 132, elapsed time information 133, and temperature history information 134, and estimates the viscosity of the ink in the discharge-pipe connection portion of the ink cartridge 42K. Accordingly, the viscosity of the ink in the discharge-pipe connection portion of the ink cartridge 42K is accurately estimated. The viscosity of the ink in the nozzle 46K is thus accurately estimated by using the estimation result of the in-cartridge ink viscosity estimation processing.

When the output voltage to be outputted from the power circuit 60 increases from the normal voltage to the high voltage, the voltage level of the drive pulse signal to be outputted to each of the piezoelectric elements 95Y, 95M, and 95C increases. The viscosities of the inks in the nozzles 46Y, 46M, and 46C through which the dye inks are jetted, however, are not likely to be equal to or more than the threshold value, as described above. Thus, when the output voltage to be outputted from the power circuit 60 increases from the normal voltage to the high voltage, liquid droplets of the inks having a size larger than the defined liquid-droplet amount defined in the liquid-droplet amount definition table 122 are jetted from the nozzles 46Y, 46M, and 46C. In that case, if the ink jetting amount is calculated in the jetting-amount calculation processing on the assumption that the amount of the liquid droplet to be jetted from each of the nozzles 46Y, 46M, and 46C per one output of each drive pulse signal to each of the piezoelectric elements 95Y, 95M, and 95C is the defined liquid-droplet amount, the jetting amount calculated is smaller than an actual jetting amount. This causes a problem in which the ink residual amount indicated by the count value of the residual-amount count information 131 of each piece of cartridge information 121Y, 121M, and 121C is larger than an actual ink residual amount.

In order to solve that problem, in this embodiment, when the output voltage to be outputted from the power circuit 60 increases from the normal voltage to the high voltage, the jetting amount of each of the color inks (yellow, cyan, and magenta inks) is calculated while reflecting the increase in the jetting amount based on the voltage increase. Details thereof are explained below An increment U', from the defined liquid-droplet amount, in the liquid droplet amount of the ink that is jetted from each of the nozzles 46Y, 46M, and 46C when the high voltage is outputted from the power circuit 60 and when any kind of drive pulse signal is outputted to each of the piezoelectric elements 95Y, 95M, and 95C, is acquired by the following equation (1).

$$U'=\alpha(V-V_0)\times U \quad (1)$$

U': increment in the liquid droplet amount $\alpha$: voltage sensitivity

V: voltage value of high voltage $V_0$: voltage value of normal voltage

U: defined liquid-droplet amount

As understood from the equation (1), the increment U' increases as the voltage value V of the high voltage is higher. The voltage sensitivity $\alpha$ indicates an increase rate of the liquid droplet amount to the voltage. The voltage sensitivity $\alpha$ depends on the ink color and the pulse waveform of the drive pulse signal. As depicted in FIG. 6C, the non-volatile memory 104 stores a voltage sensitivity table 124 in which a value of the voltage sensitivity $\alpha$ for the pulse waveform of each of the drive pulse signals is defined for each of the color inks.

When the high voltage is outputted from the power circuit 60, the CPU 101 calculates the increment in the jetting amount due to the voltage increase for each of the color inks, based on the count information outputted from the pulse waveform count circuit 154, the liquid-droplet amount definition table 122, and the voltage sensitivity table 124. The increment is added to the jetting amount that is calculated on assumption that the liquid droplet amount to be jetted from each of the nozzles 46Y, 46M, and 46C is the defined liquid-droplet amount. Accordingly, the calculation accuracy of the jetting amount of each of the yellow, cyan, and magenta inks is improved.

<Operation of Ink-Jet Printer>

Figure 7A:
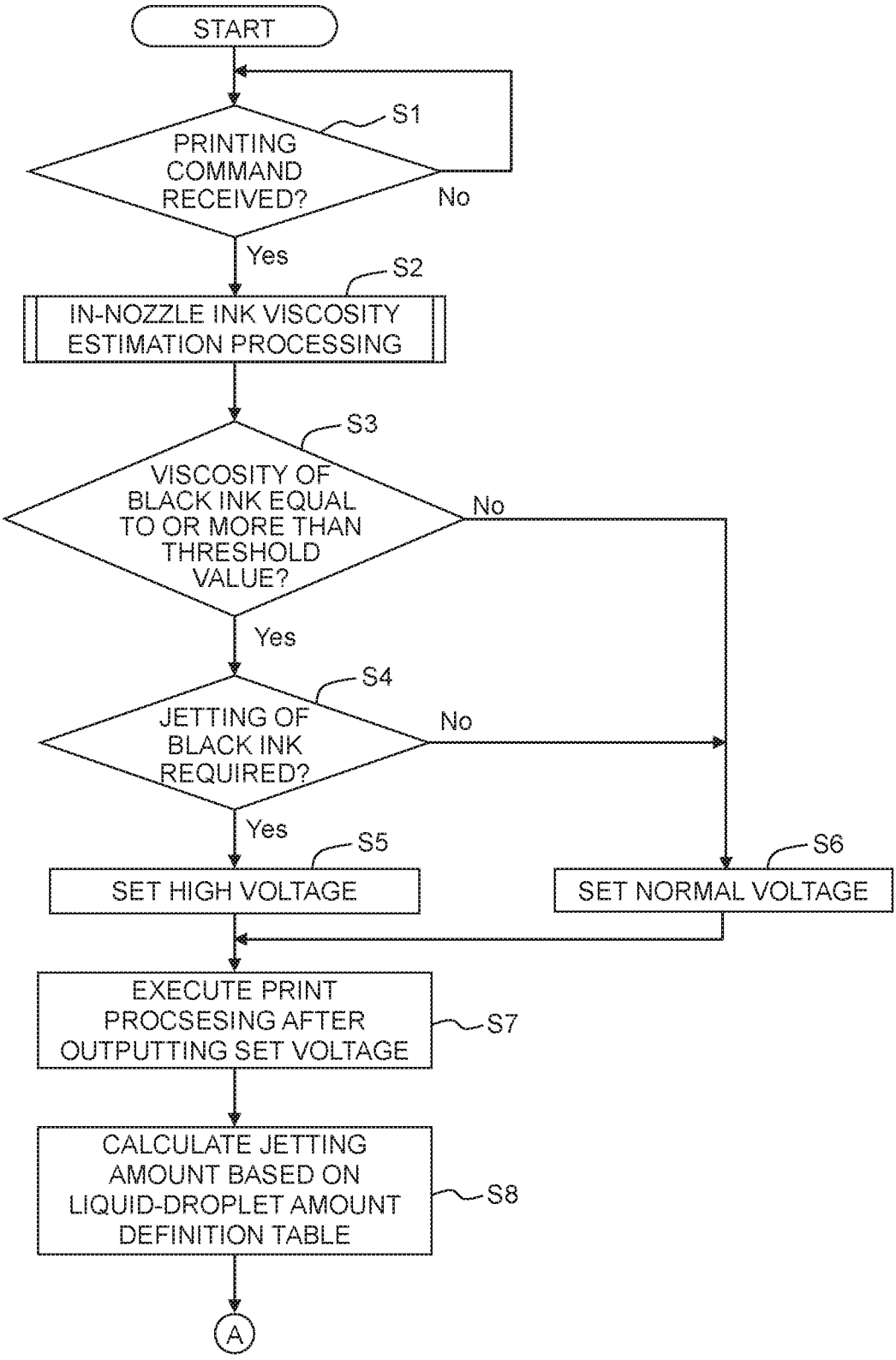
FIGS. 7A and 7B are a flowchart illustrating processing of the ink-jet printer.
Figure 7B:
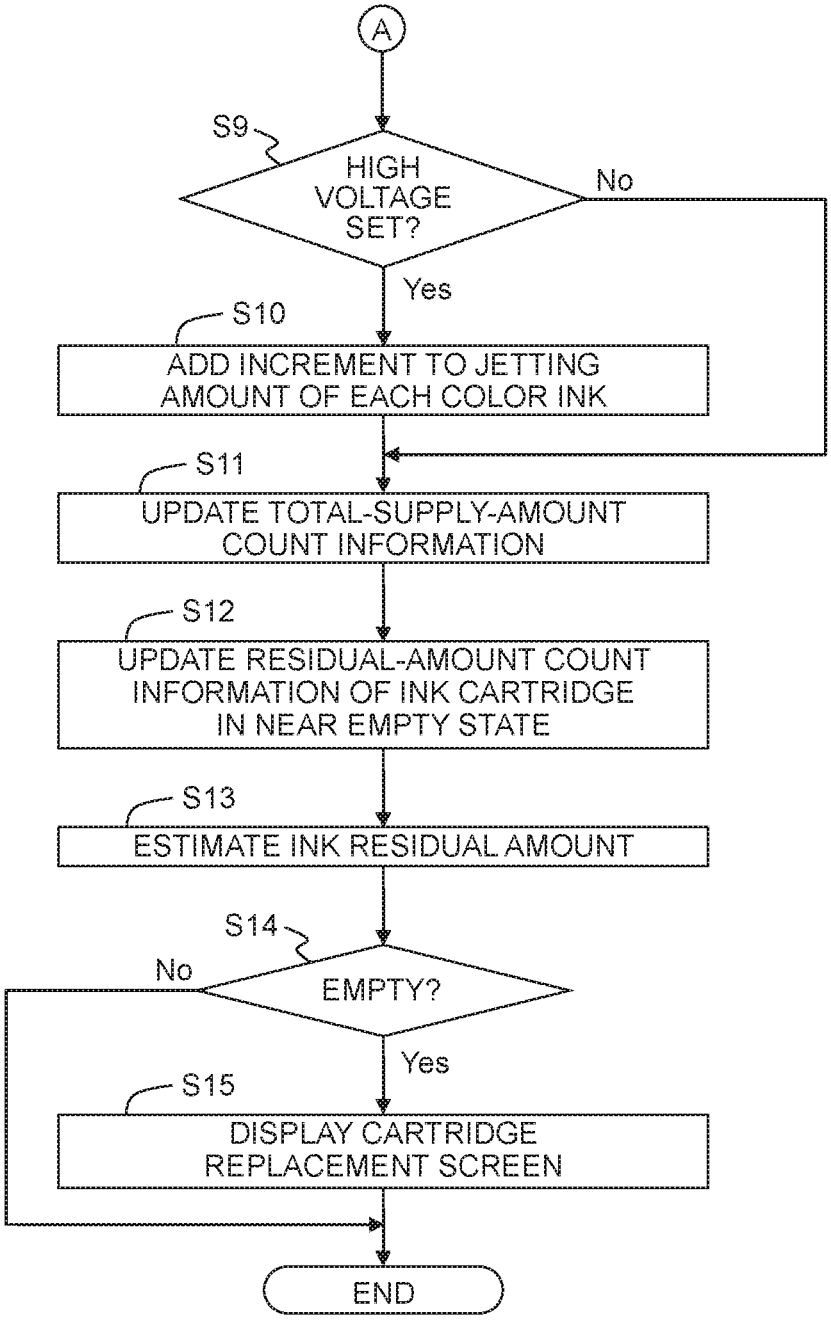

Referring to FIGS. 7A and 7B, an example of processing of the printer 1 is explained.

When executing receiving processing of receiving a printing command from the external apparatus 31 (S1: YES), the CPU 101 executes the in-nozzle ink viscosity estimation processing that is described below with reference to FIGS.

8A and 8B (S2). In the in-nozzle ink viscosity estimation processing, the viscosity of the ink in the nozzle 46K is estimated. Then, the CPU 101 determines whether the viscosity of the ink in the nozzle 46K estimated is equal to or more than the threshold value (S3). When the CPU 101 has determined that the viscosity of the ink in the nozzle 46K estimated is equal to or more than the threshold value (S3: YES), the CPU 101 executes processing of determining whether the black ink is required to be jetted, wherein it is determined whether the black ink is required to be jetted from the nozzle 46K in the print processing (S4). Specifically, when the print processing in the first print mode is requested by the printing command, the CPU 101 determines that the black ink is required to be jetted. When the print processing in the second print mode is requested by the printing command, the CPU 101 determines that no black ink is required to be jetted.

When the CPU 101 has determined that the black ink is required to be jetted in the print processing (S4: YES), the CPU 101 sets the output voltage to be outputted from the power circuit 60 to the high voltage higher than the normal voltage and stores the voltage value of the high voltage set, as voltage setting information 123, in the non-volatile memory 104 (S5). The voltage value set by the CPU 101 is higher as the viscosity of the ink in the nozzle 46K estimated in the S2 processing is higher. When completing the S5 processing, the CPU 101 proceeds to S7 processing.

When the CPU 101 has determined in the S3 processing that the viscosity of the ink in the nozzle 46K is less than the threshold value (S3: NO) or when the CPU 101 has determined in the S4 processing that no black ink is required to be jetted in the print processing (S4: NO), the CPU 101 sets the output voltage to be outputted from the power circuit 60 to the normal voltage and stores the voltage value of the normal voltage set, as the voltage setting information 123, in the non-volatile memory 104 (S6). As described above, even when the viscosity of the ink in the nozzle 46K is equal to or more than the threshold value, if no black ink is required to be jetted in the print processing, the output voltage to be outputted from the power circuit 60 is set to the normal voltage, reducing power consumption. When completing the S6 processing, the CPU 101 proceeds to S7 processing.

In the S7 processing, the CPU 101 causes the power circuit 60 to output the output voltage corresponding to the voltage value set in the voltage setting information 123 and executes the print processing of controlling the head 5 and the carriage drive motor 20 based on printing data. The processing of storing the voltage setting information 123 in the non-volatile memory 104 (S5 or S6) and the processing of causing the power circuit 60 to output the output voltage corresponding to the voltage value set in the voltage setting information 123 (S7) correspond to the power supply processing.

After the S7 processing, the CPU 101 refers to the liquid-droplet amount definition table 122 based on the count information outputted from the pulse waveform count circuit 154 and calculates, for each of the color inks, the jetting amount of ink jetted in the print processing executed in the S7 (S8).

When the voltage value set in the voltage setting information 123 is a high voltage value (S9: YES), the CPU 101 calculates, for each of the color inks, the increment in the jetting amount due to the voltage increase, based on the count information outputted from the pulse waveform count circuit 154, the liquid-droplet amount definition table 122, and the voltage sensitivity table 124 and adds the increment to the jetting amount calculated in the S8 processing (S10). The pieces of processing of S8 to S10 correspond to the jetting-amount calculation processing.

After the S10 processing, or when the voltage value set in the voltage setting information 123 in the S9 processing is not the high voltage value (S9: NO), the CPU 101 adds the jetting amount of ink calculated for the corresponding color ink to the count value of the total-supply-amount count information 132 of each piece of cartridge information 121 (S11).

The CPU 101 subtracts a value corresponding to the jetting amount calculated for the corresponding color ink from the count value of the residual-amount count information 131 of the ink cartridge 42 that has been detected by the optical sensor 72 that the ink residual amount is equal to or less than the predefined amount (near empty) (S12). Then, the CPU 101 executes the residual-amount estimation processing of estimating the ink residual amount for each of the four ink cartridges 42 by referring to the residual-amount count information 131 of the cartridge information 121 (S13). The CPU 101 determines whether the ink residual amount of any of the four ink cartridges 42 estimated in the S13 processing is zero (empty) (S14). When the CPU 101 has determined that the ink residual amount of any of the four ink cartridges 42 is zero (S14: YES), the CPU 101 displays, on the touch panel 161, the message informing a user of the need for replacement of the ink cartridge 42 that has been determined that the ink residual amount is zero (S15). Then, the CPU 101 ends this processing.

Figure 8A:
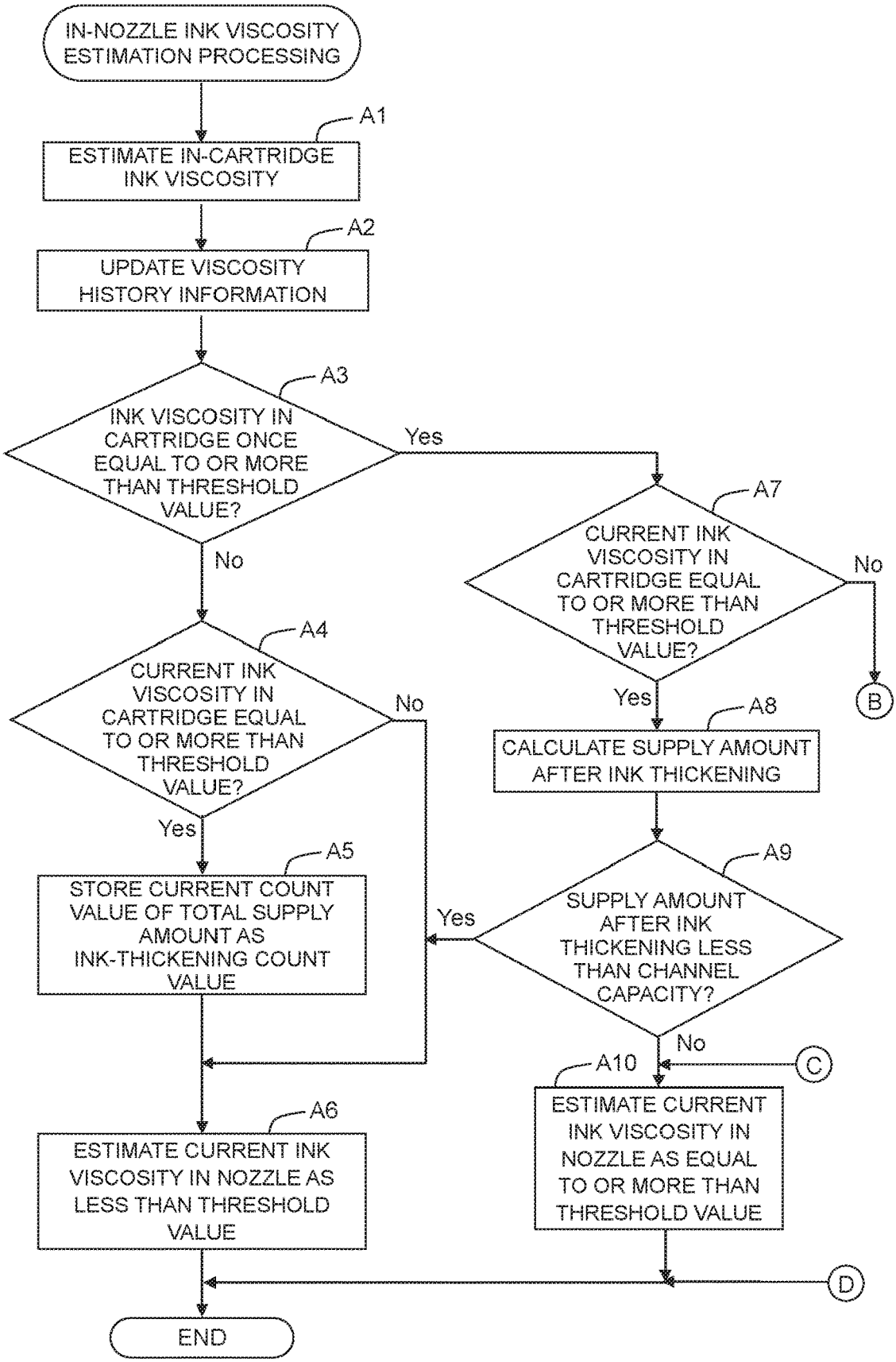
FIGS. 8A and 8B are a flowchart illustrating in-nozzle ink viscosity estimation processing.
Figure 8B:
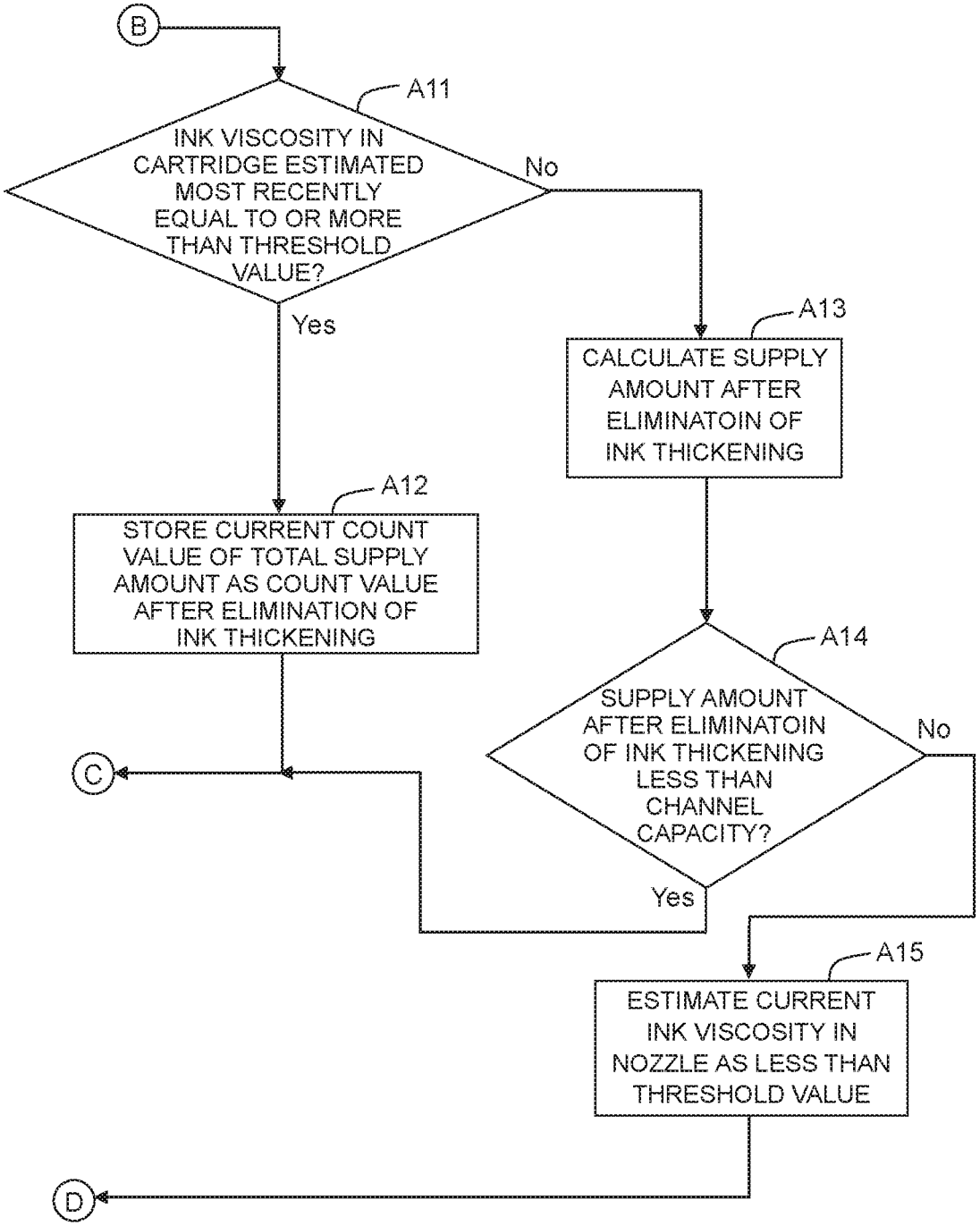

Referring to FIGS. 8A and 8B, the in-nozzle ink viscosity estimation processing is explained.

At first, the CPU 101 refers to the total-supply-amount count information 132, the elapsed time information 133, and the temperature history information 134 to execute the in-cartridge ink viscosity estimation processing of estimating a current ink viscosity in the discharge-pipe connection portion of the ink cartridge 42K (A1). Then, the CPU 101 maps the current ink viscosity estimated to a current count value of the total-supply-amount count information 132 and newly stores them in viscosity history information 135 of the cartridge information 121K in the non-volatile memory 104, thus updating the viscosity history information 135 (A2). The viscosity history information 135 is history information of ink viscosity in the discharge-pipe connection portion in which the ink viscosity in the discharge-pipe connection portion of the ink cartridge 42K is mapped to the count value of the total-supply-amount count information 132.

Next, the CPU 101 refers to the viscosity history information 135 to determine whether the ink viscosity in the discharge-pipe connection portion of the ink cartridge 42K was once equal to or more than the threshold value (A3). When the CPU 101 has determined that the ink viscosity has never been equal to or more than the threshold value (A3: NO), the CPU 101 determines whether the current ink viscosity estimated in the A2 processing is equal to or more than the threshold value (A4). When the CPU 101 has determined that the current ink viscosity is equal to or more than the threshold value (A4: YES), the CPU 101 determines that the ink viscosity in the discharge-pipe connection portion of the ink cartridge 42K has changed from less than the threshold value to equal to or more than the threshold value, and stores a current count value of the total-supply-amount count information 132, as an ink-thickening count value, in the count information 136 of the cartridge information 121K (A5). After the A5 processing or in the A4 processing, when the CPU 101 has determined that the current ink viscosity is less than the threshold value (A4: NO), the CPU 101 estimates that the ink viscosity in the nozzle 46K is less than the threshold value (A6) and ends this processing.

When the CPU 101 has determined in the A3 processing that the ink viscosity was once equal to or more than the threshold value (A3: YES), the CPU 101 determines whether the current ink viscosity estimated in the A1 processing is equal to or more than the threshold value (A7). When the CPU 101 has determined that the current ink viscosity is equal to or more than the threshold value (A7: YES), the CPU 101 calculates a supply amount of ink supplied from the ink cartridge 42K to the ink channel 30K (A8) after the ink viscosity in the discharge-pipe connection portion of the ink cartridge 42K has changed (increased) from less than the threshold value to equal to or more than the threshold value. Specifically, an amount acquired by subtracting the ink-thickening count value of the count information 136 from the current count value of the total-supply-amount count information 132 is determined as a supply amount after ink thickening. Then, the CPU 101 executes arrival estimation processing of estimating whether the thickened ink has reached the nozzle 46K by determining whether the supply amount after ink thickening is less than a channel capacity of the ink channel 30K (A9). When the CPU 101 has determined that the supply amount after ink thickening is less than the channel capacity of the ink channel 30K (A9: YES), the CPU 101 estimates that the thickened ink has not yet reached the nozzle 46 and that the viscosity of the ink in the nozzle 46K is less than the threshold value (A6). Then, the CPU 101 ends this processing.

When the CPU 101 has determined in the A9 processing that the supply amount after ink thickening is equal to or more than the channel capacity of the ink channel 30K (S9: NO), the CPU 101 estimates that the thickened ink has reached the nozzle 46 and that the viscosity of the ink in the nozzle 46K is equal to or more than the threshold value, and executes ink-thickening estimation processing of estimating that ink viscosity (A10). Specifically, the CPU 101 estimates viscosity mapped, in the viscosity history information 135, to a count value that is closest to the value acquired by subtracting the channel capacity of the ink channel 30K from the current count value of the total-supply-amount count information 132, as the viscosity of the ink in the nozzle 46K. The CPU 101 ends this processing after the A10 processing.

When the CPU 101 has determined in the A7 processing that the current ink viscosity in the discharge-pipe connection portion of the ink cartridge 42K estimated in the A2 processing is less than the threshold value (A7: NO), the CPU 101 refers to the viscosity history information 135 to determine whether the ink viscosity in the discharge-pipe connection portion of the ink cartridge 42K estimated in the in-cartridge ink viscosity estimation processing performed most recently is equal to or more than the threshold value (A11). When the CPU 101 has determined that the ink viscosity estimated most recently is equal to or more than the threshold value (A11: YES), the CPU 101 determines that the ink viscosity in the discharge-pipe connection portion of the ink cartridge 42K has changed from equal to or more than the threshold value to less than the threshold value, and stores the current count value of the total-supply-amount count information 132, as a count value after elimination of ink thickening, in the count information 136 (A12). After that, the CPU 101 returns to the A10 processing, estimates that the ink viscosity in the nozzle 46K is equal to or more than the threshold value, estimates that viscosity concretely, and ends this processing.

When the CPU 101 has determined in the A11 processing that the ink viscosity estimated most recently is less than the threshold value (A11: NC)), the CPU 101 calculates a supply amount of ink supplied from the ink cartridge 42K to the ink channel 30K (A13) after the ink viscosity in the discharge-pipe connection portion of the ink cartridge 42K has changed from equal to or more than the threshold value to less than the threshold value (after ink thickening is eliminated). Specifically, the CPU 101 determines an amount acquired by subtracting the count value after elimination of ink thickening of the count information 136 from the current count value of the total-supply-amount count information 132, as a supply amount after elimination of ink thickening. After that, the CPU 101 determines whether the supply amount after elimination of ink thickening is less than the channel capacity of the ink channel 30K (A14). When the CPU 101 has determined that the supply amount after elimination of ink thickening is less than the channel capacity of the ink channel 30K (A14: YES), the CPU 101 determines that the thickened ink still remains in the nozzle 46K, returns to the A10 processing, estimates that the viscosity of the ink in the nozzle 46K is equal to or more than the threshold value, estimates that viscosity concretely, and ends this processing. When the CPU 101 has determined that the supply amount after elimination of ink thickening is equal to or more than the channel capacity of the ink channel 30K (A14: NO), the CPU 101 determines that the thickened ink in the ink channel 30K is completely jetted from the nozzle 46K, estimates that the viscosity of the ink in the nozzle 46K is less than the threshold value (A15), and ends this processing.

In this embodiment, when the viscosity of the black ink in the nozzle 46K becomes equal to or more than the threshold value, output voltage to be outputted from the power circuit 60 increases from the normal voltage to the high voltage. This prevents jetting failure of the black ink in the print processing which may otherwise be caused by ink thickening of the black ink. As for the color inks, when the output voltage to be outputted from the power circuit 60 increases from the normal voltage to the high voltage, the jetting amount of each color ink to be jetted in the print processing increases. Thus, when the output voltage to be outputted from the power circuit 60 is the high voltage, the CPU 101 calculates, in the jetting-amount calculation processing, the jetting amount of each color ink to be larger than the jetting amount at the normal voltage while reflecting the increase in the jetting amount. This enables the CPU 101 to accurately calculate the jetting amount for each of the color inks.

In the above embodiment, the nozzle 46K corresponds to a first nozzle, and the nozzles 46Y, 46M, and 46C correspond to a second nozzle. The ink cartridge 42K corresponds to a first ink tank, and the ink cartridges 42Y, 42M, and 42C correspond to a second ink tank. The black ink (pigment ink) corresponds to a first ink, and the color inks (dye inks) correspond to a second ink. The piezoelectric element 95K corresponds to a first drive element, and the piezoelectric elements 95Y, 95M, and 95C correspond to a second drive element. The power circuit 60 corresponds to a power supply circuit. The non-volatile memory 104 corresponds to a memory. A combination of the control unit 100 and the driver IC 90 corresponds to a controller. A combination of the liquid-droplet amount definition table 122 and the voltage sensitivity table 124 corresponds to signal-related information and ink-related information. The optical sensor 72 of the cartridge installation section 41K corresponds to a first sensor, and the optical sensors 72 of the cartridge installation sections 41Y, 41M, and 41C correspond to a second sensor.

The cartridge installation section 41 corresponds to a tank installation section. The temperature sensor 160 corresponds to a temperature sensor. The discharge pipe 45 corresponds to a supply part. The printing command corresponds to a jetting command.

Subsequently, explanation will be made on modified embodiments in which a variety of modifications or changes are added to the above embodiment. In the above embodiment, the color inks (i.e., yellow, cyan, and magenta inks) are dye inks. Those color inks, however, may be pigment inks. In that case, the black pigment ink is a pigment ink of which pigment is more likely to fall than those of the color pigment inks (i.e., yellow, cyan, and magenta inks). The main reasons thereof are that a particle diameter of pigment particles of the black pigment ink is larger than those of the color pigment inks, that the pigment particles of the black pigment ink are heavier than those of the color pigment inks, and that the content of pigment particles of the black pigment ink is larger than those of the color pigment inks. Thus, when each ink cartridge 42 is kept stationary for a long time, a larger amount of the pigment falls on the bottom of the ink cartridge 42K than those in the ink cartridges 42Y, 42M, and 42C, and the viscosity of the ink in the ink cartridge 42K is higher than those in the ink cartridges 42Y, 42M, and 42C. This makes it easier for the viscosity of the ink in the nozzle 46K to be equal to or more than the threshold value than the viscosity of inks in the nozzles 46Y, 46M, and 46C. In view of the above, also in this modified embodiment, the jetting failure of black ink is prevented similarly to the above embodiment by estimating the viscosity of the ink in the nozzle 46K and adjusting the output voltage to be outputted from the power circuit 60 based on the estimation result. As for the jetting amount of each color ink, when the output voltage to be outputted from the power circuit 60 is the high voltage, the jetting amount is calculated to be larger than that at the normal voltage while reflecting the increase in the jetting amount due to the voltage increase. This enables the CPU 101 to accurately calculate the jetting amount for each color ink.

In the above embodiment, the in-nozzle ink viscosity estimation processing is executed by reflecting the pigment fall in the ink cartridge 42. The in-nozzle ink viscosity estimation processing, however, may be executed by reflecting water evaporation from the ink. Specifically, the water or moisture in the ink evaporates with time during a period in which the ink is in the ink cartridge 42 and a process in which the ink moves from the ink cartridge 42 to each nozzle 46. The evaporation amount per unit time depends on the type of ink. For example, different types of dye inks have mutually different water contents, resulting in mutually different evaporation amounts per unit time. In that case, in multiple nozzles 46, the viscosity of one of the inks having a great evaporation amount per unit time may become higher greatly than the viscosities of the remaining other inks having a small evaporation amount per unit time. In view of the above, for example, when all of the black, yellow, cyan, and magenta inks are dye inks, the CPU 101 may estimate the viscosity of the ink having the great evaporation amount per unit time based on the total-supply-amount count information 132 and the elapsed time information 133. In that case, when the viscosity of the ink having the great evaporation amount per unit time has become equal to or more than the threshold value, the output voltage to be outputted from the power circuit 60 is increased to the high voltage. Meanwhile, as for the jetting amounts of the remaining other inks having the small evaporation amount per unit time, when the output voltage to be outputted from the power circuit 60 is the high voltage, the jetting amount is calculated to be larger than that at the normal voltage while reflecting the increase in the jetting amount due to the voltage increase. This enables the CPU 10 to accurately calculate the jetting amount, preventing ink jetting failure.

Subsequently, another modified embodiment is explained. In the above embodiment, only the viscosity of the ink in the nozzle 46K from which black ink is jetted is estimated, and when the viscosity estimated is equal to or more than the threshold value, the output voltage to be outputted from the power circuit 60 is increased from the normal voltage to the high voltage. However, the viscosity of the ink in each of the nozzles 46Y, 46M, and 46C from which the corresponding one of the color inks is jetted may become equal to or more than the threshold value, causing jetting failure of each of the color inks. Especially, when each of the color inks is the pigment ink, the viscosity of the ink in each of the nozzles 46Y, 46M, and 46C is more likely to increase than a case in which each of the color inks is the dye ink. Thus, the viscosity of the ink in each of the nozzles 46Y, 46M, and 46C may become higher than the viscosity of the ink in the nozzle 46K due to the installation timing of each ink cartridge 42 in the cartridge installation section 41, etc. In view of the above, in the in-nozzle ink viscosity estimation processing according to this modified embodiment, the viscosity of ink in each nozzle 46 is estimated. When the viscosity of ink in any of the nozzles 46 is equal to or more than the threshold value, the output voltage to be outputted from the power circuit 60 is increased from the normal voltage to the high voltage. This prevents jetting failure of the color inks from the nozzles 46 which may otherwise be caused by ink thickening.

Figure 9A:
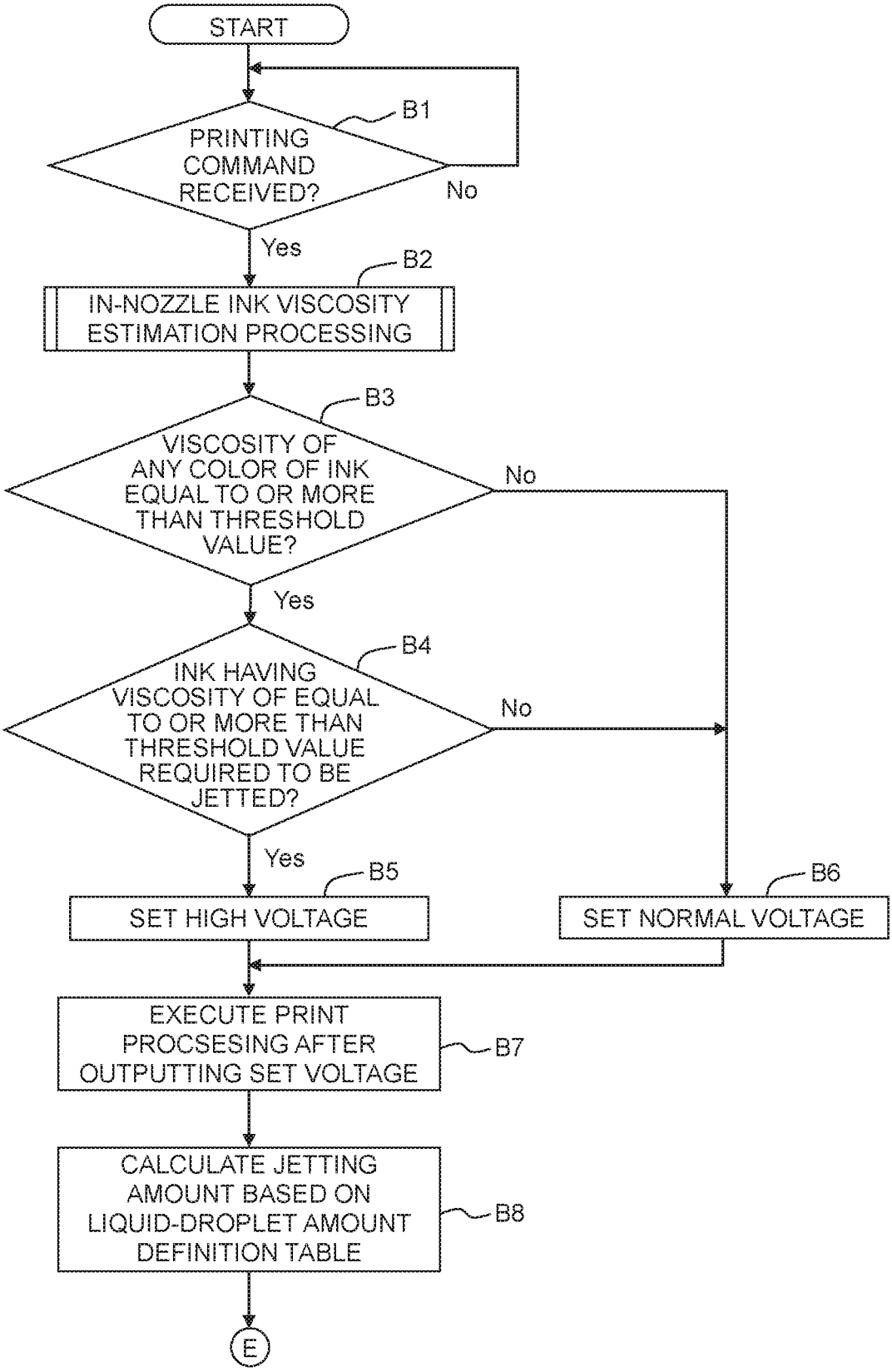
FIGS. 9A and 9B are a flowchart illustrating processing of the ink-jet printer according to a modified embodiment.
Figure 9B:
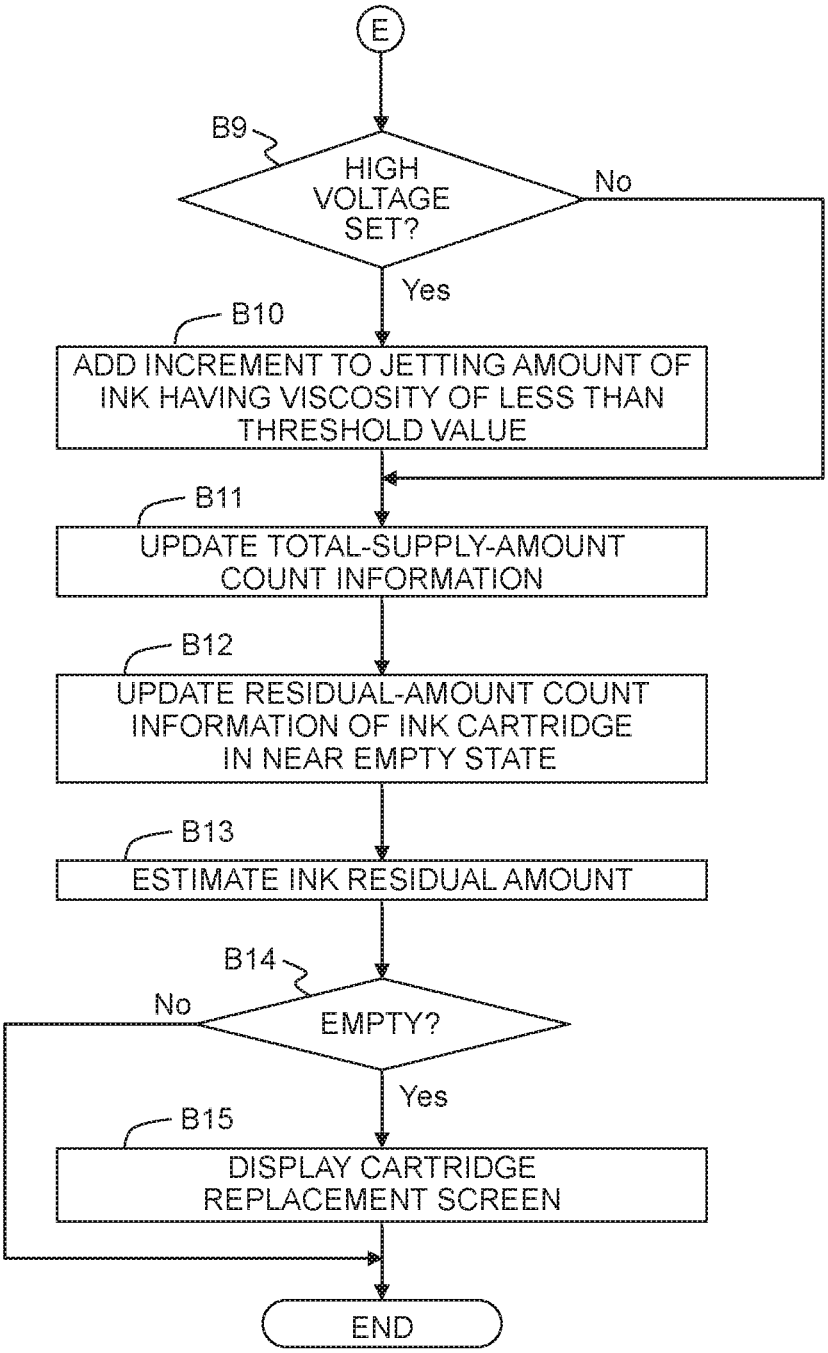

Referring to FIGS. 9A and 9B, an example of processing of the printer 1 according this modified embodiment is explained. In the voltage sensitive table 124 of the non-volatile memory 104, a value of the voltage sensitivity a for black ink is defined for the pulse waveform of each drive pulse signal. Each piece of cartridge information 121 stores the residual-amount count information 131, the total-supply-amount count information 132, the elapsed time information 133, the temperature history information 134, the viscosity history information 135, and the count information 136.

When receiving a printing command from the external apparatus 31 (B1: YES), the CPU 101 executes the in-nozzle ink viscosity estimation processing explained above with reference to FIGS. 8A and 8B, for each of the inks (B2). In the in-nozzle ink viscosity estimation processing, not only the viscosity of the ink in the nozzle 46K but also the viscosity of the ink in each of the nozzles 46Y, 46M, and 46C is estimated. After that, the CPU 101 determines whether the viscosity of the ink in any of the nozzles 46 estimated is equal to or more than the threshold value (B3). When the CPU 101 has determined that the viscosity of the ink in any of the nozzles 46 is equal to or more than the threshold value (B3: YES), the CPU 101 determines, based on the printing command received, whether the ink is required to be jetted from that nozzle 46 in the print processing (B4).

When the CPU 101 has determined that the ink is required to be jetted from that nozzle 46 in the print processing (B4: YES), the CPU 101 sets the output voltage to be outputted from the power circuit 60 to the high voltage higher than the normal voltage. Then, the CPU 101 stores the voltage value of the high voltage set, as the voltage setting information 123, in the non-volatile memory 104 (B5).

When the CPU 101 has determined in the B3 processing that the viscosities of the inks in all the nozzles 46 are less than the threshold value (B3: NO) or when the CPU has determined in the B4 processing that no ink is required to be jetted from that nozzle 46 in the print processing (B4: NO), the CPU 101 sets the output voltage to be outputted from the power circuit 60 to the normal voltage, and stores the voltage value of the normal voltage set, as the voltage setting information 123, in the non-volatile memory 104 (B6).

After the B5 processing or the B6 processing, the CPU101 executes B7 processing and B8 processing that are similar to the S7 processing and the S8 processing. After that, when the voltage value set in the voltage setting information 123 is a high voltage value (B9: YES), the CPU 101 calculates, based on the count information outputted from the pulse waveform count circuit 154, the liquid-droplet amount definition table 122, and the voltage sensitivity table 124, the increment in the jetting amount due to the voltage increase for each of the inks that has been estimated in the B3 processing that the viscosity is less than the threshold value, and adds the increment to the jetting amount calculated in the B8 processing (B10).

After the B10 processing or when the voltage value set in the voltage setting information 123 in the B9 processing is not the high voltage value (B9: NO), the CPU101 executes pieces of processing of B11 to B15 that are similar to the pieces of processing S11 to S15, and ends this processing.

In this modified embodiment, when the viscosity of the ink in a certain nozzle 46 has become equal to or more than the threshold value, the output voltage to be outputted from the power circuit 60 increases from the normal voltage to the high voltage. This prevents jetting failure of ink from the certain nozzle 46 in the print processing which may otherwise be caused by ink thickening. As for the jetting amount of ink that has been estimated that the viscosity of the ink in the nozzle 46 is less than the threshold value, when the output voltage to be outputted from the power circuit 60 is the high voltage, the jetting amount is calculated to be larger than that at the normal voltage while reflecting the increase in the jetting amount due to the voltage increase. This enables the CPU101 to accurately calculate the ink jetting amount.

Any other modified embodiments are described below.

In the above embodiment, when the output voltage to be outputted from the power circuit 60 increases from the normal voltage to the high voltage, the jetting amount of each of the color inks (yellow, cyan, and magenta inks) is calculated while reflecting the increase in the jetting amount based on the voltage increase (namely, difference between the high voltage and the normal voltage). However, the jetting amount of each of the color inks may be calculated while reflecting the increase in the jetting amount based on ratio of the high voltage to the normal voltage. In this case, the ink jetting amount can be calculated accurately.

The in-nozzle ink viscosity estimation processing may be processing of estimating a viscosity of ink present in a channel area that includes at least the nozzle 46K. For example, the in-nozzle ink viscosity estimation processing may be processing of estimating a viscosity of ink present in a channel having influence on ink jetting, such as a channel ranging from the pressure chamber 83 to the nozzle 46K.

There may be a case in which the optical sensor 72 detects the near empty when the initial value of the count value of the residual-amount count information 131 is set to zero. In that case, every time the CPU 101 executes the jetting-amount calculation processing, the CPU 101 may add the jetting amount calculated to the count value of the residual-amount count information 131. The CPU 101 determines that the residual amount of ink in the ink cartridge 42 is zero when the count value of the residual-amount count information 131 has reached a predefined amount corresponding to the near empty. The optical sensor 72 may not be provided. In that configuration, the CPU 101 may determine the residual amount of ink in each ink cartridge 42 based only on the count value of the total-supply-amount count information 132.

The present teaching may be applied to a printer of an on-carriage type in which a carriage carries a cartridge installation section in which an ink cartridge is installed. The discharge pipe 45 of the ink cartridge 42 may not be connected to the lower portion of the storage chamber 44. The discharge pipe 45, for example, may be connected to a middle portion of the storage chamber 44. When the viscosity of the ink in the nozzle 46K is equal to or more than the threshold value, the high voltage may be outputted from the power circuit 60 without being influenced by the printing mode.

In the above embodiment, the tank that is a supply source of ink is the ink cartridge. The present teaching, however, is not limited thereto. For example, the tank may be a pouch-type ink storage bag made using a flexible resin. The ink storage bag includes a cap connectable to the ink supply tube 22. When the ink supply tube 22 is connected to the cap, the ink inside the ink storage bag is allowed to flow through the ink supply tube 22.

In the above embodiment, voltage sensitivity information related to the liquid droplet amount for each of the inks is stored, in advance, in the voltage sensitivity table 124 of the non-volatile memory 104 of the printer 1. The present teaching, however, is not limited thereto. For example, each ink cartridge 42 may include a memory configured to store the voltage sensitivity information related to the liquid droplet amount of the ink stored, and the CPU 101 may acquire the voltage sensitivity information for each of the inks by receiving the voltage sensitivity information stored in the memory.

In the above embodiment, the inks stored in the respective ink cartridges 42 are mutually different colors of inks. The inks, however, may have the same color provided that components or ingredients are different from each other In the above embodiment, the drive element applying energy to the ink in each nozzle 46 is the piezoelectric element. The present teaching, however, is not limited thereto. For example, the drive element may be a heating element that causes film boiling through heating of ink. The power supply circuit that generates the voltage to be applied commonly to the piezoelectric elements 95 may be mounted on the head 5. In the in-cartridge ink viscosity estimation processing of the above embodiment, the CPU 101 estimates the fall amount of the pigment based on the total-supply-amount count information 132, the elapsed time information 133, and the temperature history information 134, and estimates the viscosity of the ink in the discharge-pipe connection portion of the ink cartridge 42K. The CPU 101, however, may estimate the fall amount of the pigment based only on the total-supply-amount count information 132 and the elapsed time information 133. The fall amount of the pigment is smaller as the residual amount of ink in the ink cartridge 42 is smaller. Thus, the CPU 101 may estimate whether the viscosity of the ink in the discharge-pipe connection portion of the ink cartridge 42K has changed from equal to or more than the threshold value to less than the threshold value, based only on the ink supply amount after ink thickening.

The present teaching is applicable also to a line-type ink-jet printer in which a fixed ink-jet head prints an image on a sheet conveyed by a conveying mechanism.

What is claimed is:

1. An ink-jet recording apparatus, comprising:

an ink-jet head including: a first nozzle from which a first ink is jetted; a second nozzle from which a second ink different from the first ink is jetted; a first drive element configured to apply energy to the first ink for jetting the first ink from the first nozzle; and a second drive element configured to apply energy to the second ink for jetting the second ink from the second nozzle, the first ink being supplied from a first ink tank, the second ink being supplied from a second ink tank;

a power supply circuit configured to generate a drive voltage being commonly applied to the first drive element and the second drive element; and a controller configured to:

estimate viscosity of the first ink in the first nozzle;

control the power supply circuit to generate a first drive voltage in a case that the viscosity of the first ink in the first nozzle estimated is less than a threshold value;

control the power supply circuit to generate a second drive voltage higher than the first drive voltage in a case that the viscosity of the first ink in the first nozzle estimated is equal to or more than the threshold value;

drive the first drive element and the second drive element by the drive voltage generated in the power supply circuit, for jetting the first ink and the second ink from the first nozzle and the second nozzle respectively based on jetting instruction; and calculate a jetting amount of the first ink to be jetted from the first nozzle and a jetting amount of the second ink to be jetted from the second nozzle based on the jetting instruction, wherein the controller is configured to make a calculation such that a jetting amount of the second ink to be jetted from the second nozzle in a case that the second drive voltage is applied to the second drive element is larger, by a predefined amount, than a jetting amount of the second ink to be jetted from the second nozzle in a case that the first drive voltage is applied to the second drive element, and the predefined amount is an amount according to increase in a jetting amount based on the second drive voltage and the first drive voltage.

2. The ink jet recording apparatus according to claim 1, wherein the predefined amount is an amount according to increase in a jetting amount based on a difference between the second drive voltage and the first drive voltage.

3. The ink-jet recording apparatus according to claim 1, wherein the predefined amount is an amount according to increase in a jetting amount based on a ratio of the second drive voltage to the first drive voltage.

4. The ink-jet recording apparatus according to claim 1, wherein a first jetting amount of the first ink is jetted from the first nozzle in a case that the first drive voltage is applied to the first drive element, a second jetting amount of the first ink is jetted from the first nozzle in a case that the second drive voltage is applied to the first drive element, and the controller is configured to set a voltage value of the second drive voltage such that a difference between the first jetting amount and the second jetting amount is within a predefined ratio relative to the first jetting amount.

5. The ink-jet recording apparatus according to claim 1, wherein the controller is further configured to receive, from an external apparatus, a jetting command by which the first ink and the second ink are jetted from the first nozzle and the second nozzle respectively, and the controller is configured to:

estimate a viscosity of the first ink in the first nozzle after receiving the jetting command and before jetting the first ink and the second ink from the first nozzle and the second nozzle based on the jetting command; and generate the first drive voltage or the second drive voltage based on the viscosity of the first ink in the first nozzle estimated.

6. The ink-jet recording apparatus according to claim 1, wherein the controller is further configured to:

receive, from an external apparatus, a jetting command by which the first ink and the second ink are respectively jetted from the first nozzle and the second nozzle; and determine whether the first ink is required to be jetted based on the jetting command received, and wherein, in a case that the controller has determined that the first ink is not required to be jetted, the controller is configured to control the power supply circuit to generate the first drive voltage even in a case that the viscosity of the first ink in the first nozzle estimated is equal to or more than the threshold value.

7. The ink-jet recording apparatus according to claim 1, wherein the controller is configured to selectively output, to the first drive element and the second drive element, multiple kinds of drive pulse signals having mutually different pulse waveforms, the multiple kinds of drive pulse signals having a voltage level depending on the drive voltage generated in the power supply circuit, the ink-jet recording apparatus further includes a memory configured to store signal-related information being related to: a jetting amount of the second ink to be jetted from the second nozzle in the case that the first drive voltage is generated in the power supply circuit and that each of the multiple kinds of drive pulse signals is applied to the second drive element; and a jetting amount of the second ink to be jetted from the second nozzle in the case that the second drive voltage is generated in the power supply circuit and that each of the multiple kinds of drive pulse signals is applied to the second drive element, and the controller is configured to calculate a jetting amount of the second ink to be jetted from the second nozzle by referring to the signal-related information stored in the memory.

8. The ink-jet recording apparatus according to claim 1, wherein the second nozzle is included in second nozzles, the second ink is included in multiple kinds of second inks, the multiple kinds of second inks are respectively jetted from the second nozzles, the second drive element is included in second drive elements respectively corresponding to the second nozzles, the ink-jet recording apparatus further includes a memory configured to store ink-related information related to:

jetting amounts of the multiple kinds of second inks to be jetted respectively from the second nozzles in a case that the first drive voltage is applied to the second drive elements; and jetting amounts of the multiple kinds of second inks to be jetted respectively from the second nozzles in a case that the second drive voltage is applied to the second drive elements, and the controller is configured to calculate jetting amounts of the multiple kinds of second inks to be jetted respectively from the second nozzles by referring to the ink-related information stored in the memory.

9. The ink-jet recording apparatus according to claim 1, wherein, in a case that the viscosity of the first ink in the first nozzle estimated is equal to or more than the threshold value, the controller is configured to control the power supply circuit to generate the second drive voltage such that a voltage value increases as the viscosity of the first ink in the first nozzle is higher, and in the case that the second drive voltage is generated in the power supply circuit, the controller is configured to calculate a jetting amount of the second ink such that the jetting amount of the second ink to be jetted from the second nozzle increases as the voltage value of the second drive voltage is higher.

10. The ink-jet recording apparatus according to claim 1, wherein the first ink and the second ink are pigment inks, weight of pigment particles of the first ink is larger than weight of pigment particles of the second ink, and a content of the pigment particles of the first ink is greater than a content of the pigment particles of the second ink.

11. The ink-jet recording apparatus according to claim 1, wherein the controller is further configured to:

estimate a residual amount of the first ink in the first ink tank based on the jetting amount of the first ink calculated; and estimate a residual amount of the second ink in the second ink tank based on the jetting amount of the second ink calculated.

12. The ink-jet recording apparatus according to claim 11, further comprising:

a first sensor configured to detect that the residual amount of the first ink in the first ink tank is equal to or less than a first predefined amount; and a second sensor configured to detect that the residual amount of the second ink in the second ink tank is equal to or less than a second predefined amount, and wherein, in a case that the first sensor has detected that the residual amount of the first ink in the first ink tank is equal to or less than the first predefined amount, the controller is configured to estimate the residual amount of the first ink in the first ink tank based on the first predefined amount and a jetting amount of the first ink which has been calculated after the detection by the first sensor, and in a case that the second sensor has detected that the residual amount of the second ink in the second ink tank is equal to or less than the second predefined amount, the controller is configured to estimate the residual amount of the second ink in the second ink tank based on the second predefined amount and a jetting amount of the second ink which has been calculated after the detection by the second sensor.

13. The ink-jet recording apparatus according to claim 11, wherein the controller is configured to set a voltage value of the second drive voltage generated in the power supply circuit such that a jetting amount of the first ink in a case that the second drive voltage is applied to the first drive element is smaller than a jetting amount of the first ink in a case that the first drive voltage is applied to the first drive element.

14. The ink-jet recording apparatus according to claim 1, wherein the first ink is a pigment ink and the second ink is a dye ink.

15. The ink-jet recording apparatus according to claim 13, further comprising:

a tank installation section in which the first ink tank is installable; and a temperature sensor, wherein the first ink tank includes a storage chamber in which the first ink is stored and a supply part connected to the storage chamber and configured to externally supply the first ink stored in the storage chamber, the controller is configured to:

acquire a total supply amount of the first ink supplied from the first ink tank to the ink-jet head from a point of time at which the first ink tank is installed in the tank installation section; a temperature measurement result by using the temperature sensor from the point of time at which the first ink tank is installed in the tank installation section; and elapsed time from the point of time at which the first ink tank is installed in the tank installation section;

estimate, based on the pieces of information acquired, whether a fall of the pigment ink of the first ink in the first ink tank has made the viscosity of the first ink to be discharged from the first ink tank change from less than the threshold value to equal to or more than the threshold value; and estimate the viscosity of the first ink in the first nozzle based on a result of the estimation of the viscosity of the first ink to be discharged from the first ink tank.

16. The ink-jet recording apparatus according to claim 15, wherein the controller is configured to:

acquire a total supply amount of the first ink supplied from the first ink tank to the ink-jet head from a point of time at which the controller has estimated that the viscosity of the first ink to be discharged from the first ink tank has changed from less than the threshold value to equal to or more than the threshold value;

estimate, based on the total supply amount of the first ink acquired, whether the first ink discharged from the first ink tank and having the viscosity of equal to or more than the threshold value has reached the first nozzle; and estimate that the viscosity of the first ink in the first nozzle is equal to or more than the threshold value in the case of estimating that the first ink discharged from the first ink tank and having the viscosity of equal to or more than the threshold value has reached the first nozzle.

17. The ink-jet recording apparatus according to claim 15, wherein the controller is configured to:

acquire a total supply amount of the first ink supplied from the first ink tank to the ink-jet head from a point of time at which the controller has estimated that the viscosity of the first ink to be discharged from the first ink tank has changed from less than the threshold value to equal to or more than the threshold value; and estimate, based on the total supply amount of the first ink acquired, whether supply of the first ink having the viscosity of equal to or more than the threshold value from the first ink tank to the ink-jet head has changed the viscosity of the first ink to be discharged from the first ink tank from equal to or more than the threshold value to less than the threshold value.

18. An ink-jet recording apparatus, comprising:

an ink-jet head including: nozzles from which multiple kinds of inks are respectively jetted; and drive elements respectively corresponding to the nozzles, the multiple kinds of inks being supplied from ink tanks to the nozzles, the drive elements being configured to apply energy to the multiple kinds of inks for jetting the multiple kinds of inks from the nozzles;

a power supply circuit configured to generate a drive voltage which is commonly applied to the drive elements; and a controller configured to:

estimate viscosities of the multiple kinds of inks in the nozzles;

control the power supply circuit to generate a first drive voltage in a case that all the viscosities of the multiple kinds of inks in the nozzles estimated are less than a threshold value;

control the power supply circuit to generate a second drive voltage higher than the first drive voltage in a case that a viscosity of a predefined ink in a predefined nozzle is equal to or more than the threshold value, the predefined ink being included in the multiple kinds of inks, the predefined nozzle being included in the nozzles;

drive the drive elements by the drive voltage generated in the power supply circuit for jetting the multiple kinds of inks respectively from the nozzles based on jetting instruction; and calculate jetting amounts of the multiple kinds of inks to be jetted respectively from the nozzles based on the jetting instruction, wherein the controller is configured to make a calculation so that a jetting amount of the predefined ink to be jetted from the predefined nozzle in a case that the second drive voltage is applied to a predefined drive element corresponding to the predefined nozzle is larger, by a predefined amount, than a jetting amount of the predefined ink to be jetted from the predefined nozzle in a case that the first drive voltage is applied to the predefined drive element, and the predefined amount is an amount according to increase in a jetting amount based on the second drive voltage and the first drive voltage.

19. The inkjet recording apparatus according to claim 18, wherein the predefined amount is an amount according to increase in a jetting amount based on a difference between the second drive voltage and the first drive voltage.

20. The ink-jet recording apparatus according to claim 18, wherein the predefined amount is an amount according to increase in a jetting amount based on a ratio of the second drive voltage to the first drive voltage.

* * * * *